US005899804A

United States Patent [19]

Chiba et al.

[11] Patent Number: 5,899,804

[45] Date of Patent: May 4, 1999

[54] COIN RECEIVING AND DISPENSING MACHINE

[75] Inventors: Hiroshi Chiba, Kawaguchi; Hideyuki Ebihara, Hachioji; Mitsuo Sakamoto, Omiya, all of Japan

[73] Assignee: Laurel Bank Machines Co., Ltd., Tokyo, Japan

[21] Appl. No.: 08/934,500

[22] Filed: Sep. 19, 1997

[30] Foreign Application Priority Data

| | | | |
|---|---|---|---|
| Sep. 20, 1996 | [JP] | Japan | 8-250680 |
| Sep. 24, 1996 | [JP] | Japan | 8-252035 |
| Sep. 12, 1997 | [JP] | Japan | 9-248832 |

[51] Int. Cl.[6] ..... G07D 3/02; G07D 1/04; G07F 1/04

[52] U.S. Cl. ..... 453/11; 453/32; 194/346

[58] Field of Search ..... 453/3, 4, 9, 11, 453/56, 32; 194/346

[56] References Cited

U.S. PATENT DOCUMENTS 5,059,153 10/1991 Goi ..... 453/11

FOREIGN PATENT DOCUMENTS 63-249289 10/1988 Japan .
2124813 2/1984 United Kingdom ..... 453/56

*Primary Examiner*—F. J. Bartuska
*Assistant Examiner*—Bryan J. Jaketic
*Attorney, Agent, or Firm*—Frishauf, Holtz, Goodman, Langer & Chick, P.C.

[57] ABSTRACT

A coin receiving and dispensing machine includes a coin discriminating and counting section for discriminating whether or not coins are acceptable and the denominations of the acceptable coins and counting the coins, coin sorting sections for sorting coins based on the result of the discrimination made by the coin discriminating and counting section, a coin temporary storing section for temporarily storing acceptable coins sorted by the coin sorting sections in accordance with their denominations, a dispensable coin storing section for receiving coins temporarily stored in the coin temporary storing section and storing them in accordance with their denominations, a safe for collecting coins, and a chute for feeding coins from the dispensable coin storing section to the safe. According to the thus constituted coin receiving and dispensing machine, it is possible to easily collect coins after the completion of business with a compact structure.

14 Claims, 21 Drawing Sheets

COIN RECEIVING AND DISPENSING MACHINE

BACKGROUND OF THE INVENTION

The present invention relates to a coin receiving and dispensing machine and particularly to a table-type coin receiving and dispensing machine.

DESCRIPTION OF THE PRIOR ART

Japanese Patent Application Laid Open No. 63-249289 discloses a table-type coin receiving and dispensing machine which uses received coins for dispensation.

This coin receiving and dispensing machine comprises a dispensable coin storing section for storing coins in accordance with their denominations and a box-type received coin storing section for temporarily storing coins deposited through a coin depositing opening and discriminated to be acceptable and is constituted so as to replenish coins with coins stored in the received coin storing section when the number of coins stored in the dispensable coin storing section decreases to a predetermined number.

In this coin receiving and dispensing machine, when coins are to be collected after the completion of business, coins stored in the box-type received coin storing section are collected by taking out the received coin storing section itself and coins stored in the dispensable coin storing section are fed onto a receiving tray set in a coin release opening to be collected. Therefore, since coins stored in the received coin storing section and coins stored in the dispensable coin storing section are separately collected, the coin collecting operation is troublesome.

If coins stored in the received coin storing section are fed into the dispensable coin storing section and collected together with coins stored in the dispensable coin storing section, it is impossible to collect coins stored in the received coin storing section together with coins stored in the dispensable coin storing section by feeding them into the dispensation coin storing section, because the coin storing capacity of the dispensable coin storing section is small in the table-type coin receiving and dispensing machine.

To the contrary, it is possible to feed coins stored in the dispensable coin storing section into the received coin storing section and collect them together with coins stored in the received coin storing section. However, a special transport mechanism is necessary in order to do so. This creates a problem of enlarging the table-type coin receiving and dispensing machine, which is required to be compact.

SUMMARY OF THE INVENTION

It is therefore an object of the present invention to provide a table-type coin receiving and dispensing machine which is compact and in which coins can be easily collected after the completion of business.

The above and other objects of the present invention can be accomplished by a coin receiving and dispensing machine comprising a coin depositing opening through which coins can be deposited, a coin passage for transporting coins deposited through the coin depositing opening one by one, coin discriminating and counting means for discriminating whether or not coins are acceptable and the denominations of the acceptable coins and counting the coins, coin sorting means for sorting coins based on the result of the discrimination made by the coin discriminating and counting means, a coin temporary storing section for temporarily storing coins discriminated to be acceptable by the coin discriminating and counting means and sorted by the coin sorting means in accordance with their denominations, a dispensable coin storing section for receiving coins temporarily stored in the coin temporary storing section and storing them in accordance with their denominations, a safe for collecting coins, and chute means for feeding coins from the dispensable coin storing section to the safe.

In a preferred aspect of the present invention, the dispensable coin storing section is disposed below the coin temporary storing section and at a position where it can receive coins dropped from the coin temporary storing section.

In a further preferred aspect of the present invention, the coin temporary storing section comprises a plurality of coin temporary storing units for temporarily storing coins for dispensation in accordance with their denominations and the dispensable coin storing section comprises a plurality of dispensable coin storing units for receiving coins from the plurality of coin temporary storing units and storing them in accordance with their denominations, each of the plurality of coin temporary storing units comprising a belt conveyor for receiving and transporting coins, each of the belt conveyors being swingable about a widthwise axis and the plurality of dispensable coin storing units being adapted to receive coins dropped from lower end portions of the swung belt conveyors.

In a further preferred aspect of the present invention, the coin receiving and dispensing machine further includes a coin dispensing opening through which coins can be dispensed and the chute means is adapted to selectively feed coins stored in the dispensable coin storing section to the safe or the coin dispensing opening.

In a further preferred aspect of the present invention, the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

In a further preferred aspect of the present invention, the coin receiving and dispensing machine further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

The above and other objects and features of the present invention will become apparent from the following description made with reference to the accompanying drawings.

DESCRIPTION OF THE PREFERRED EMBODIMENTS

Figure 1:
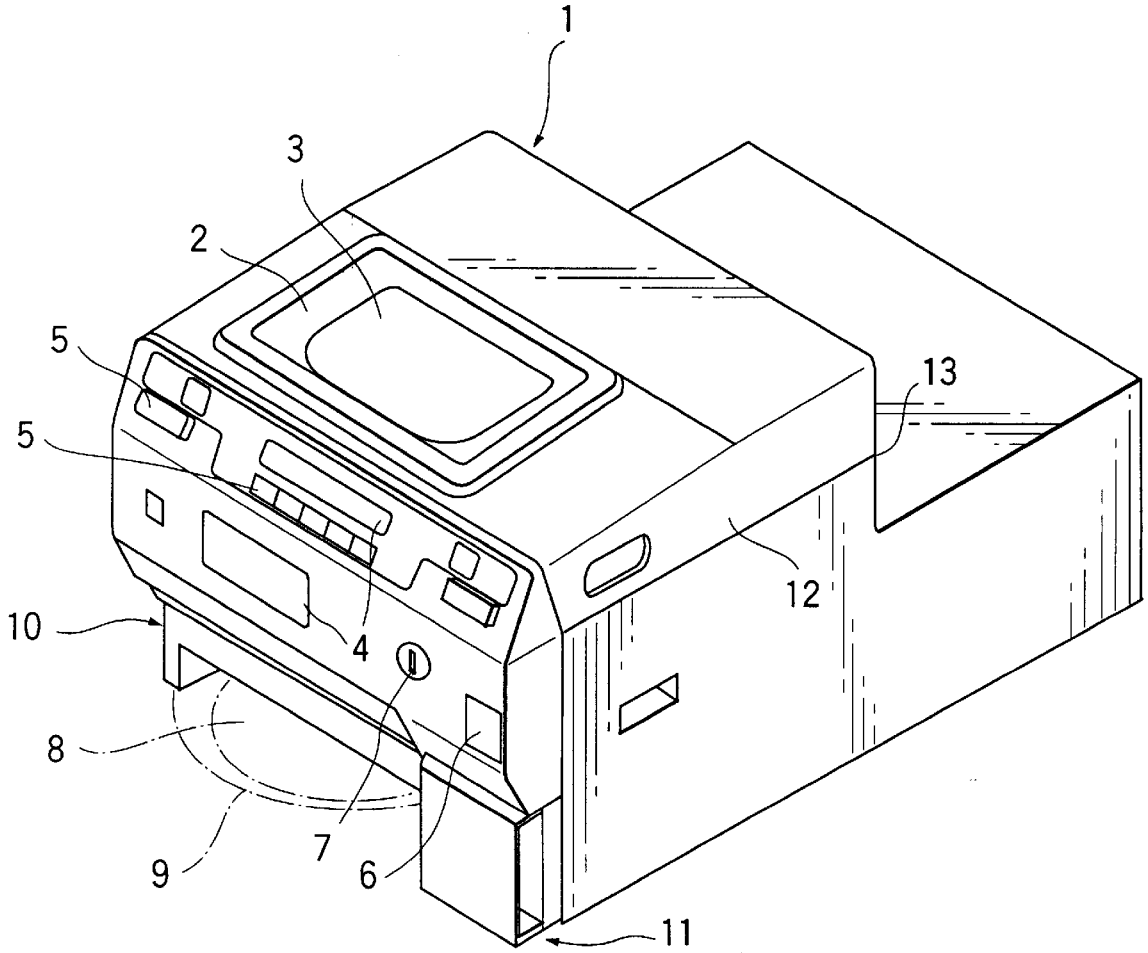
FIG. 1 is a schematic perspective view of the appearance of a coin receiving and dispensing machine which is a preferred embodiment of the present invention.

As shown in FIG. 1, a coin receiving and dispensing machine 1 is provided with a coin depositing opening 2 having an opening facing upwardly on the upper surface thereof and a shutter 3 is supported below the coin depositing opening 2 to be slidable in the fore-aft direction for opening and closing the coin depositing opening 2.

A display section 4 and an operating section 5 are formed on the front surface of the coin receiving and dispensing machine 1 and the display section 4 is constituted so as to display the results of counting deposited coins C, instructions to the operator and the like. Further, the front surface of the coin receiving and dispensing machine 1 is formed with a coin returning opening 6 for returning coins C discriminated to be unacceptable among the deposited coins C and a key inserting section 7 into which a key can be inserted.

The lower portion on the front side of the coin receiving and dispensing machine 1 is formed with a coin dispensation opening 8 for dispensing coins C. The coins C are dispensed onto a receiving tray 9 inserted into the coin dispensation opening 8. At a lower portion on the front side of the coin receiving and dispensing machine 1, a dispensable coin storing section 10 comprising dispensable coin storing units (not shown) for storing coins in accordance with their denominations and a safe section 11 for accommodating a safe (not shown) for collecting coins which cannot be stored in the dispensable coin storing units and coins stored in the dispensable coin storing units. The coin storing section 10 and the safe section 11 are provided so that they can be drawn out. When the dispensable coin storing section 10 and the safe section 11 are pushed to predetermined positions, they are automatically locked and when the key is inserted into the key inserting section 7 to release the lock, they can be drawn out.

The upper portion of the coin receiving and dispensing machine 1 formed with the coin depositing opening 2, the shutter 3 and operating section 5 forms an upper cover 12 which is provided on the coin receiving and dispensing machine 1 so as to be swingable about an end edge 13 and the upper cover 12 can be opened by inserting the key into the key inserting section 7 and releasing the lock and is automatically locked when closed.

Figure 2:
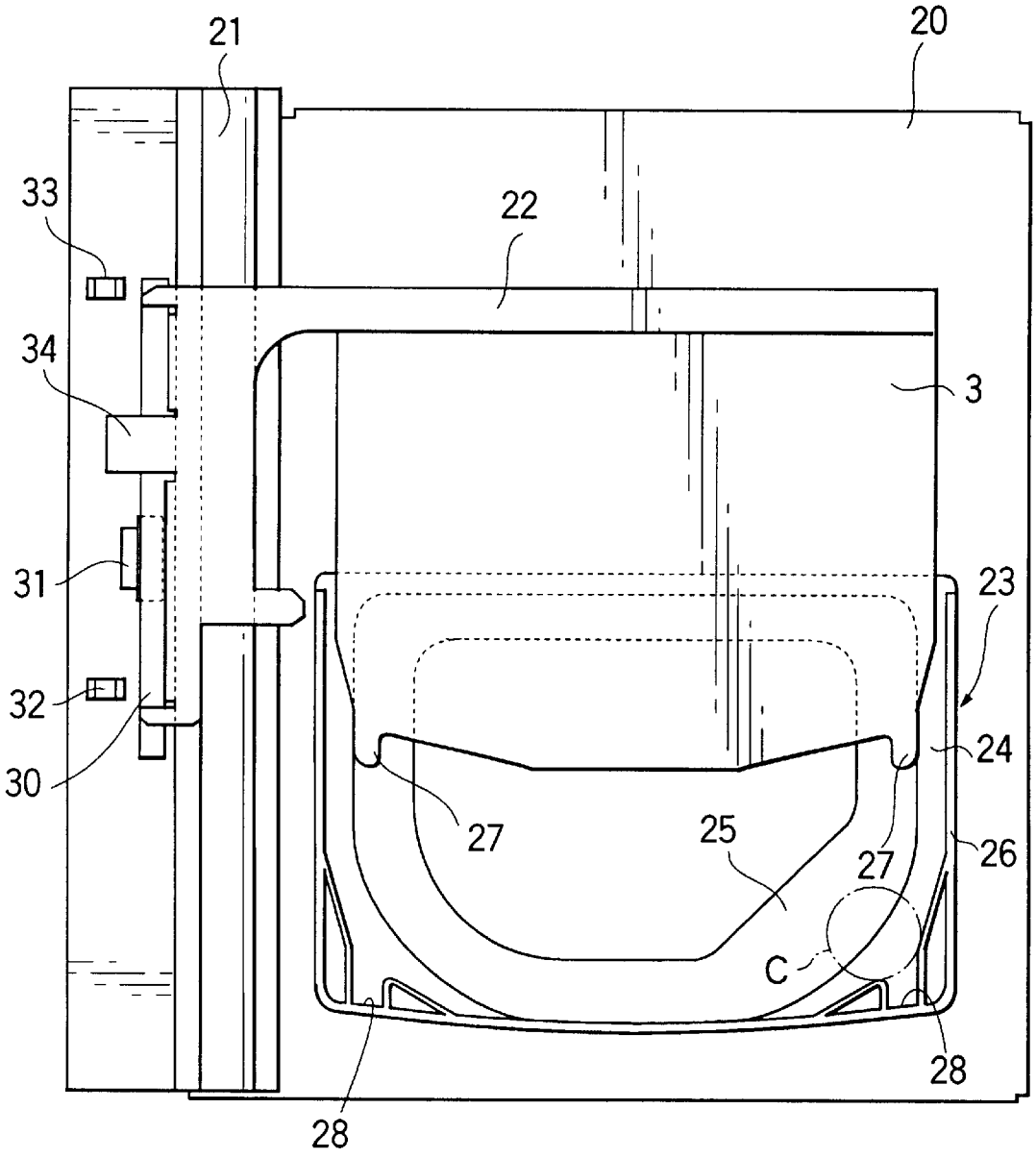
FIG. 2 is a schematic partial plan view of a driving mechanism for the shutter.

FIG. 2 is a schematic partial plan view of a driving mechanism for the shutter 3.

As shown in FIG. 2, a shutter unit 20 is mounted on the lower surface of the upper cover 12 and a slide shaft 21 extending in the longitudinal direction is fixed to the shutter unit 20. A shutter mounting member 22 is mounted on the slide shaft 21 to be slidable in the longitudinal direction.

The rear end portion of the shutter 3 is mounted on the shutter mounting member 22 and the front end portion of the shutter 3 is supported by a shutter guide 23 of the shutter unit 20. The shutter guide 23 comprises a frame portion 24 having substantially a rectangular shape whose center coincides with the center of the coin depositing opening 2, a hopper portion 25 inclined downwardly toward the inside portion of the frame portion 24 and a projecting portion 26 formed on the outer sides of the frame portion 24 on the right and left and front sides thereof and projecting upwardly from the frame portion 24. The frame portion 24 of the shutter guide 23 is disposed in such a manner that the clearance between itself and the lower surface of the upper cover 12 is equal to the thickness of the shutter 3 and the projecting portion 26 projects upwardly by a distance equal to the thickness of the shutter 3 and is adapted to support the outer portion of the shutter 3 when the coin depositing opening 2 is closed by the shutter 3.

Both edges of the front end portion of the shutter 3 are formed with convex portions 27 projecting forwardly and the projecting portion 26 of the shutter guide 23 is formed with concave portions 28 having complementary shapes to those of the convex portions 27 for receiving the convex portions 27 of the shutter 3 when the shutter 3 closes the coin depositing opening 2.

In the vicinity of the slide shaft 21 of the shutter mounting member 22, a rack member 30 is fixed along the slide shaft 21 and a drive gear 31 is provided so as to mesh with the rack member 30. When the drive gear 31 is driven by a shutter motor (not shown), the shutter 3 is moved along the slide shaft 21 in the longitudinal direction, thereby closing the coin depositing opening 2. A first sensor 32 and a second sensor 33 are provided on the body of the coin receiving and dispensing machine 1 and it is possible to judge whether the shutter 3 closes or opens the coin depositing opening 2 depending on which of the first sensor 32 and the second sensor 33 detects a detection piece 34 formed on the shutter mounting member 22.

Figure 3:
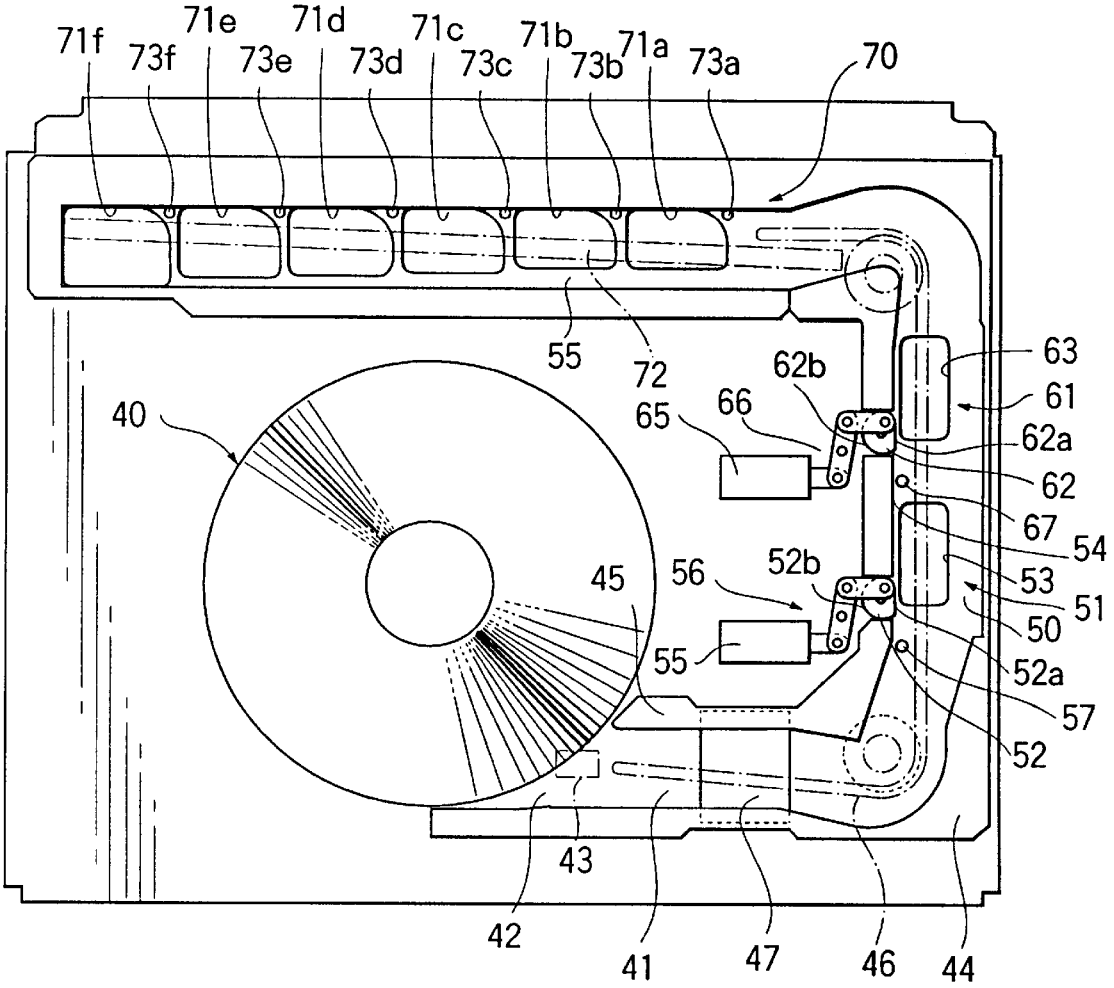
FIG. 3 is a schematic plan view of a mechanism disposed below the upper cover for discriminating, counting and sorting coins deposited through the coin depositing opening in accordance with their denominations.

FIG. 3 is a schematic plan view of a mechanism disposed below the upper cover 12 for discriminating, counting and sorting coins deposited through the coin depositing opening 2 in accordance with their denominations.

As shown in FIG. 3, a mechanism for discriminating, counting and sorting coins deposited through the coin depositing opening 2 in accordance with their denominations is provided below the upper cover 12.

A rotatable disk 40 is provided below the coin depositing opening 2 for receiving coins deposited through the coin depositing opening 2 and feeding them out by a centrifugal force and a coin passage 41 extending along the front portion of the coin receiving and dispensing machine 1 communicates with the rotatable disk 40.

An annular guide (not shown) is provided about the circumference of the rotatable disk 40 and coins deposited onto the rotatable disk 40 are fed along the annular guide by the centrifugal force produced by the rotation of the rotatable disk 40 to a coin take-out opening 42 formed in the annular guide. Coins are separated and fed one by one into the coin passage 41 by a separating member (not shown) provided in the coin take-out opening 42. Each coin fed into the coin passage 41 is accelerated by a roller 43 disposed adjacent to the coin take-out opening 42 to be separated from the following coin and conveyed in the coin passage 41.

The coin passage 41 is formed between a pair of guide members 44, 45 and a transport belt 46 is provided so as to hold coins between the upper surface of the coin passage 41 and itself.

In the coin passage 41, a coin discriminating section 47 is provided for discriminating whether or not each coin is acceptable and the denomination of each acceptable coin and counting the number of acceptable coins. The coin discriminating section 47 comprises optical sensors for detecting the diameter, the surface pattern, the side surface pattern and the like of each coin, magnetic sensors for detecting magnetic properties of each coin, and the like. The results of discriminating coins are input into a control section (not shown) and the results of counting coins are displayed on the display section 4.

A first coin sorting passage 50 extending along the side portion of the coin receiving and dispensing machine 1 is connected to the downstream end of the coin passage 41 and the transport belt 46 extends from the coin passage 41 to the first coin sorting passage 50.

The first coin sorting passage 50 is provided with a first coin sorting section 51. The first coin sorting section 51 has a projecting member 52 and a sorting opening 53. The projecting member 52 is rotatable about a vertical axis and is formed with a flat wall portion 52*a* and a cylindrical wall portion 52*b*. When the flat wall portion 52*a* is positioned to face the first coin sorting passage 51, the flat wall portion 52*a* is flush with a guide wall 54 of the first coin sorting passage 50 and, on the other hand, when the cylindrical wall portion 52*b* is positioned to face the first coin sorting passage 50, the cylindrical wall portion 52*b* projects from the guide wall 54 into the first coin sorting passage 50. Therefore, when the projecting member 52 is positioned in such a manner that the flat wall portion 52*a* faces the first coin sorting passage 50, a coin is further fed along downstream the guide wall 54 in the first coin sorting passage 50 and when the projecting member 52 is positioned in such a manner that the cylindrical wall portion 52*b* faces the first coin sorting passage 50, a coin is pushed away from the guide wall 54 by the projecting member 52. The projecting member 52 is constituted so as to be rotated via a link mechanism 56 by a solenoid 55.

The first coin sorting passage 50 is provided with a second coin sorting section 61 downstream of the first coin sorting section 51. The second coin sorting section 61 has the same structure as that of the first coin sorting section 51 and has a rotatable projecting member 62 and a sorting opening 63. The projecting member 62 is formed with a flat wall portion 62*a* and a cylindrical wall portion 62*b* and is constituted so as to be rotated via a link mechanism 66 by a solenoid 65.

Sensors 57 and 67 are respectively provided immediately upstream of the first coin sorting section 51 and the second coin sorting section 61.

When the sensor 57 detects a coin discriminated to be acceptable by the coin discriminating section 47, the projecting member 52 is positioned so that the flat wall portion 52*a* faces the first coin sorting passage 50, thereby allowing the acceptable coin to pass through the first coin sorting section 51 and, on the other hand, when the sensor 57 detects a coin discriminated to be unacceptable by the coin discriminating section 47, the projecting member 52 is rotated so that the cylindrical wall portion 52*b* faces the first coin sorting passage 51, thereby pushing the unacceptable coin away from the guide wall and dropping it into the sorting opening 53.

On the other hand, the second coin sorting section 61 is adapted to lead to a coin temporary storing section (not shown) coins which are acceptable but cannot be used for dispensation because the number of coins of the denomination stored in the coin receiving and dispensing machine 1 is too great. As described in detail later, the coin receiving and dispensing machine 1 according to this embodiment has a coin temporary storing section (not shown) comprising coin temporary storing units for storing coins to be dispensed in accordance with their denominations and a collected coin temporary storing unit for storing coins to be collected into a safe and a dispensable coin storing section 10 comprising dispensable coin storing units for receiving coins from the coin temporary storing units of the coin temporary storing section and storing them for dispensation in accordance with their denominations. Coins are fed into the coin temporary storing units via coin sorting openings described later. Therefore, when the number of coins capable of being stored in a dispensable coin storing unit for storing coins of a specific denomination decreases to less than a predetermined number, if a coin of the denomination is fed into the coin temporary storing unit in which coins of the denomination are to be stored, there is a risk of the coin not being stored in the coin temporary storing unit. Therefore, the second coin sorting section 61 is constituted so as to feed only coins of the denomination at risk into the collected coin temporary storing unit of the coin temporary storing section and to store the coins therein, thereby collecting them into a safe (not shown).

A second coin sorting passage 70 extending along the rear portion of the coin receiving and dispensing machine 1 is connected to the downstream portion of the first coin sorting passage 50. The transport belt 46 extends from the coin passage 41 through the first coin sorting passage 50 and terminates at the upstream portion of the second coin sorting passage 70.

The second coin sorting passage 70 is formed with coin sorting openings 71*a*, 71*b*, 71*c*, 71*d*, 71*e* and 71*f* and a transport belt 72 for transporting coins is provided in the second coin sorting passage 70 so as to hold coins between the upper surface of the second coin sorting passage 70 and itself. The coin sorting openings 71*a*, 71*b*, 71*c*, 71*d*, 71*e* and 71*f* are formed so that the diameter of one located upstream is smaller than that of one located downstream.

Sensors 73*a*, 73*b*, 73*c*, 73*d*, 73*e* and 73*f* are respectively provided immediately upstream of the coin sorting openings 71*a*, 71*b*, 71*c*, 71*d*, 71*e* and 71*f*.

The coin sorting openings 71*a*, 71*b*, 71*c*, 71*d*, 71*e* and 71*f* are adapted to store coins in the coin temporary storing units of the coin temporary storing section described next in accordance with their denominations.

Figure 4:
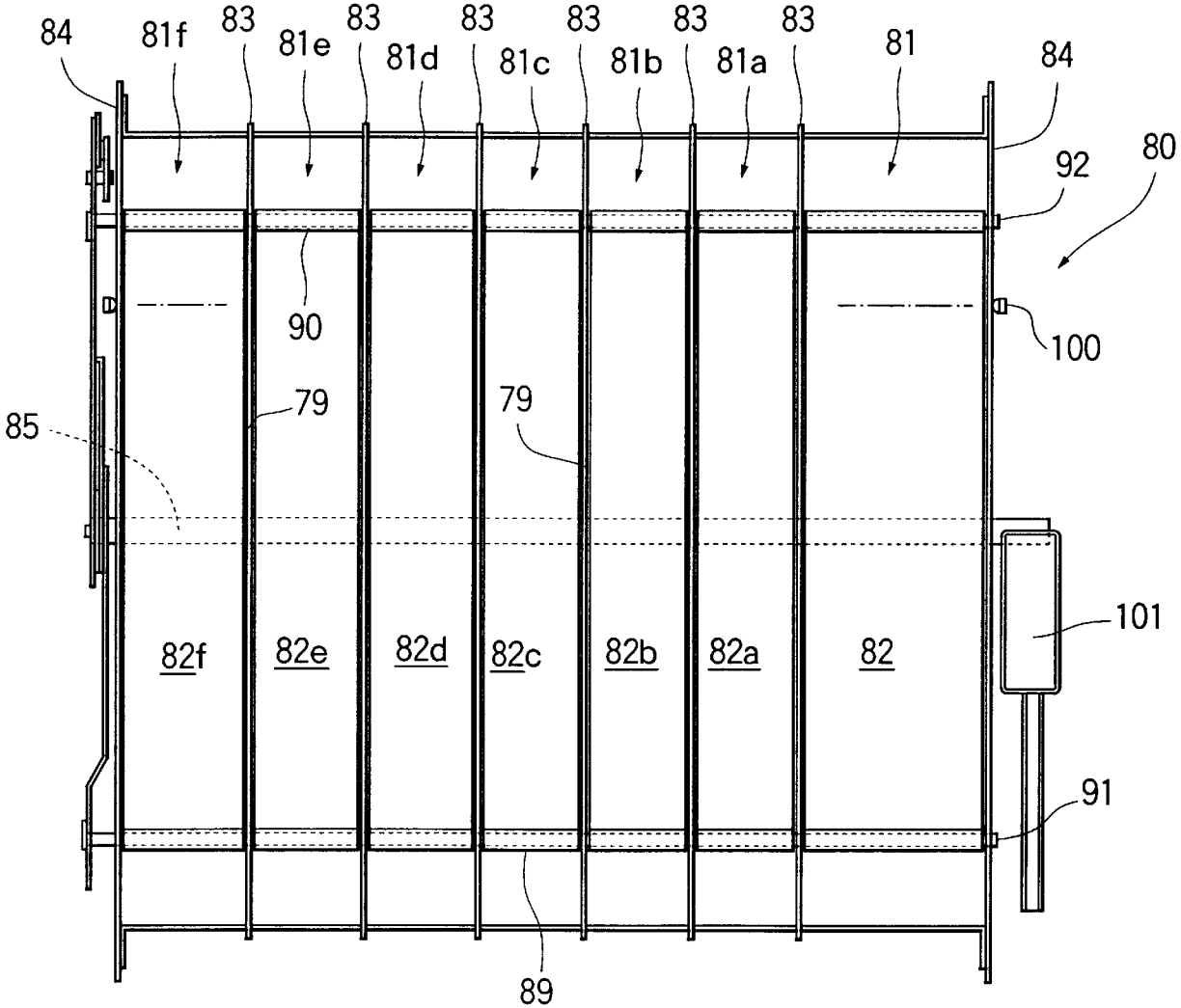
FIG. 4 is a schematic plan view of a coin temporary storing section.
Figure 5:
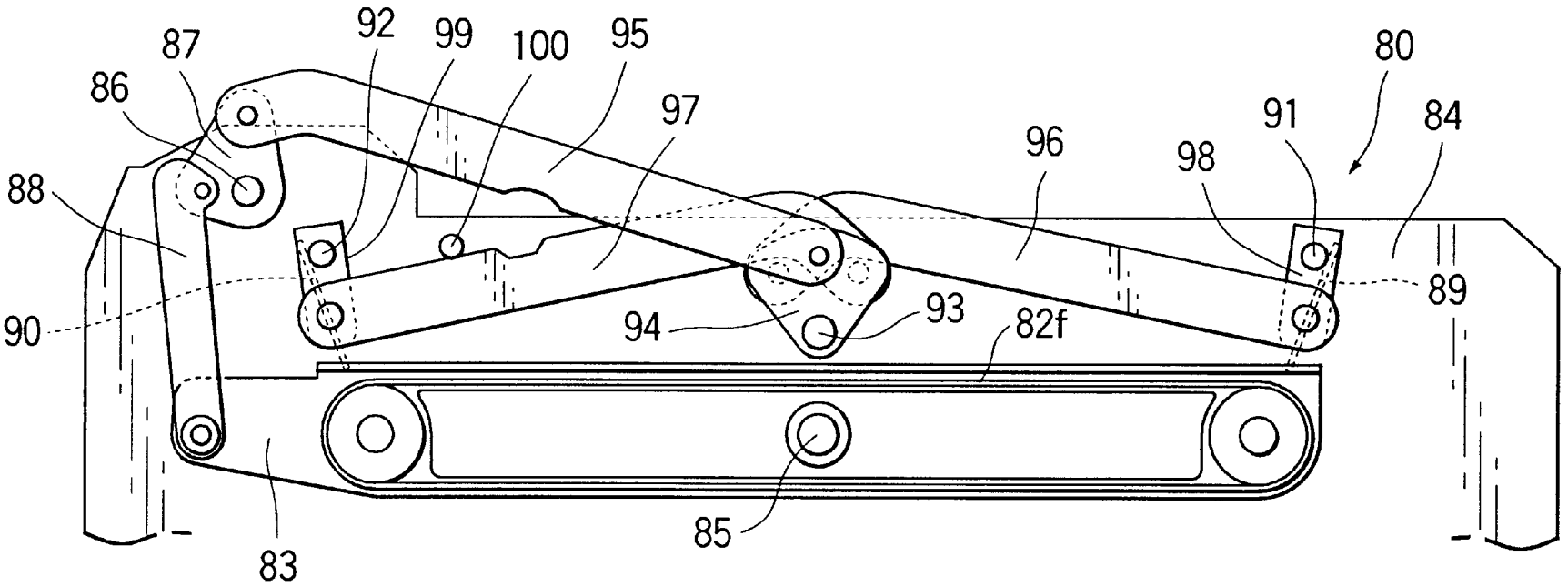
FIG. 5 is a schematic left side view of the coin temporary storing section shown in FIG. 4.

FIG. 4 is a schematic plan view of the coin temporary storing section and FIG. 5 is a schematic left side view of the coin temporary storing section shown in FIG. 4.

The coin temporary storing section 80 is disposed immediately below the coin discriminating, counting and sorting mechanism shown in FIG. 3 and is adapted to temporarily store coins dropped through the sorting opening 63 of the second coin sorting section 61 and the coin sorting openings 71*a*, 71*b*, 71*c*, 71*d*, 71*e* and 71*f* of the second coin sorting passage 70. As shown in FIG. 4, the coin temporary storing section 80 is provided with a collected coin temporary storing unit 81 and coin temporary storing units 81*a*, 81*b*, 81*c*, 81*d*, 81*e* and 81*f*. The collected coin temporary storing unit 81 is adapted to temporarily store coins dropped through the sorting opening 63 of the second coin sorting section 61. Coins temporarily stored in the collected coin temporary storing unit 81 are collected into a safe when a coin receipt instruction signal is input through the operating section, while they are returned onto the receiving tray 9 set below the coin releasing opening via a chute described later when a coin receipt stop signal is input. The coin temporary storing units 81*a*, 81*b*, 81*c*, 81*d*, 81*e* and 81*f* are adapted to temporarily store coins dropped through the coin sorting openings 71*a*, 71*b*, 71*c*, 71*d*, 71*e* and 71*f* of the second coin sorting passage 70 in accordance with their denominations. As described later, coins temporarily stored in the coin temporary storing units 81*a*, 81*b*, 81*c*, 81*d*, 81*e* and 81*f* are fed into dispensable coin storing units of a dispensable coin storing section for storing coins to be dispensed and stored therein in accordance with their denominations, when a coin receipt instruction signal is input through the operating section 5 and, when a coin receipt stop signal is input, the coins are returned onto the receiving tray 9 set below a coin releasing opening via a chute and the coin releasing opening described later.

As shown in FIGS. 4 and 5, the coin temporary storing units 81*a*, 81*b*, 81*c*, 81*d*, 81*e* and 81*f* extend horizontally and are respectively provided with belt conveyors 82*a*, 82*b*, 82*c*, 82*d*, 82*e* and 82*f* and adjacent coin temporary storing units 81*a*, 81*b*, 81*c*, 81*d*, 81*e*, 81*f* are separated by a separation members 79.

The belt conveyors 82*a*, 82*b*, 82*c*, 82*d*, 82*e* and 82*f* are constituted so as to be driven in forward and backward directions by a single motor (not shown).

As shown in FIG. 5, the belt conveyors 82*a*, 82*b*, 82*c*, 82*d*, 82*e* and 82*f* are integrally mounted on a belt conveyor unit 83 and the belt conveyor unit 83 is supported by a support shaft 85 extending in a widthwise direction through a center portion of a pair of unit side plates 84, 84. A swing drive shaft 86 extending in a widthwise direction is mounted on a rear and upper portion of the unit side plates 84, 84 and a cam 87 is fixed to the swing drive shaft 86. The cam 87 and one end portion of the belt conveyor unit 83 are connected by a link 88 so that when the cam 87 is rotated, the link 88 is moved upwardly and downwardly, thereby swinging the belt conveyor unit 83 about the support shaft 85.

As shown in FIGS. 4 and 5, above the front end portions of the belt conveyors 82*a*, 82*b*, 82*c*, 82*d*, 82*e* and 82*f* of the coin temporary storing units 81*a*, 81*b*, 81*c*, 81*d*, 81*e* and 81*f*, a gate member 89 is provided and above the rear end portions thereof, a gate member 90 is provided. These gate members 89, 90 are intended to prevent coins dropped onto the belt conveyors 82*a*, 82*b*, 82*c*, 82*d*, 82*e* and 82*f* of the coin temporary storing units 81*a*, 81*b*, 81*c*, 81*d*, 81*e* and 81*f* through the sorting opening 63 and the coin sorting openings 71*a*, 71*b*, 71*c*, 71*d*, 71*e* and 71*f* from being dropped from the front end portions and the rear end portions of the belt conveyors 82*a*, 82*b*, 82*c*, 82*d*, 82*e* and 82*f*. The gate member 89 is fixed to a support shaft 91 rotatably mounted on the unit side plates 84 and the gate member 90 is fixed to a support shaft 92 rotatably mounted on the unit side plates 84.

A support shaft 93 extending in the widthwise direction is supported by the unit side plates 84, 84 above the support shaft 85 supporting the belt conveyor unit 83 and a cam 94 is swingably supported by the support shaft 93. The upper portion of the cam 94 and the upper portion of the cam 87 are connected by a link 95. A link 96 is connected to the front portion of the cam 94 and a link 97 is connected to the rear portion of the cam 94. The other end portion of the link 96 is connected to one end portion of a link 99 whose other end portion is connected to the support shaft 92. Therefore, when the cam 87 is swung, the cam 94 is swung and, as a result, the links 96 and 97 rotate the support shafts 91 and 92 via the links 98 and 99 to swing the gate members 89 and 90, thereby selectively moving the gate members 89, 90 apart from the belt conveyors 82*a*, 82*b*, 82*c*, 82*d*, 82*e* and 82*f*.

Figure 6:
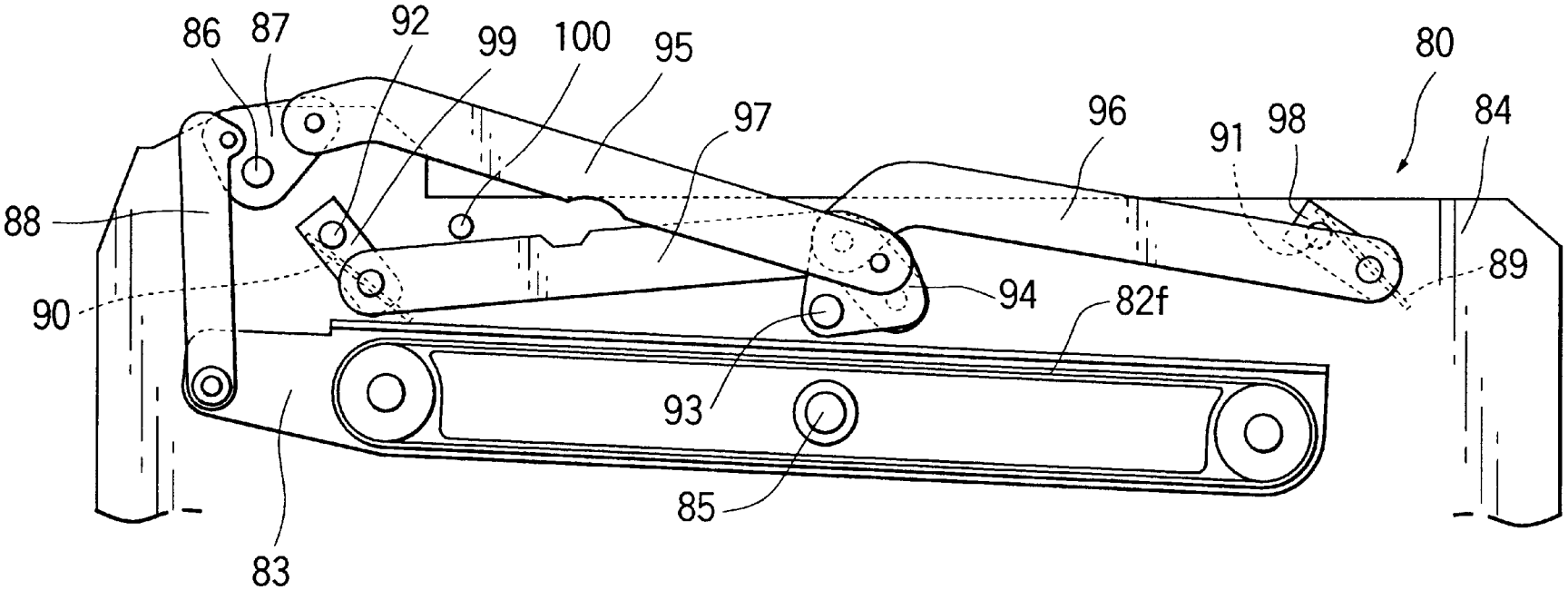
FIG. 6 is a schematic left side view of the coin temporary storing section showing it releasing coins on belt conveyors forwardly.

FIG. 6 is a schematic left side view of the coin temporary storing section 80 showing it releasing coins on the belt conveyors 82*a*, 82*b*, 82*c*, 82*d*, 82*e* and 82*f* forwardly. Coins are deposited in the coin receiving and dispensing machine 1 according to this embodiment through the coin depositing opening 2 and stored in the coin temporary storing section 80. However, if the operator inputs a coin receipt stop signal through the operating section 5 after the counted value of the deposited coins counted by the coin discriminating section 47 was displayed on the display section 4, the coins stored in the coin temporary storing section 80 are fed to a chute and returned to a coin releasing opening. For enabling such an operation, a chute (not shown) is provided below the front end portion of the coin temporary storing section 80 so as to communicate with a coin releasing opening (not shown).

As shown in FIG. 6, when the swing drive shaft 86 is rotated clockwise, the cam 87 is rotated clockwise and the link 88 is moved upwardly so that the front end portion of the belt conveyor unit 83 is inclined downwardly. At the same time, the cam 94 is rotated clockwise and the support shaft 91 is rotated counterclockwise via the links 96 and 98, whereby the gate member 89 disposed on the front side is moved apart from the belt conveyors 82*a*, 82*b*, 82*c*, 82*d*, 82*e* and 82*f*. Therefore, it is possible to release coins on the belt conveyors 82*a*, 82*b*, 82*c*, 82*d*, 82*e* and 82*f* forwardly. The coins forwardly released from the belt conveyors 82*a*, 82*b*, 82*c*, 82*d*, 82*e* and 82*f* are returned onto the receiving tray 9 set below a coin releasing opening via a chute and a coin releasing opening described later.

Figure 7:
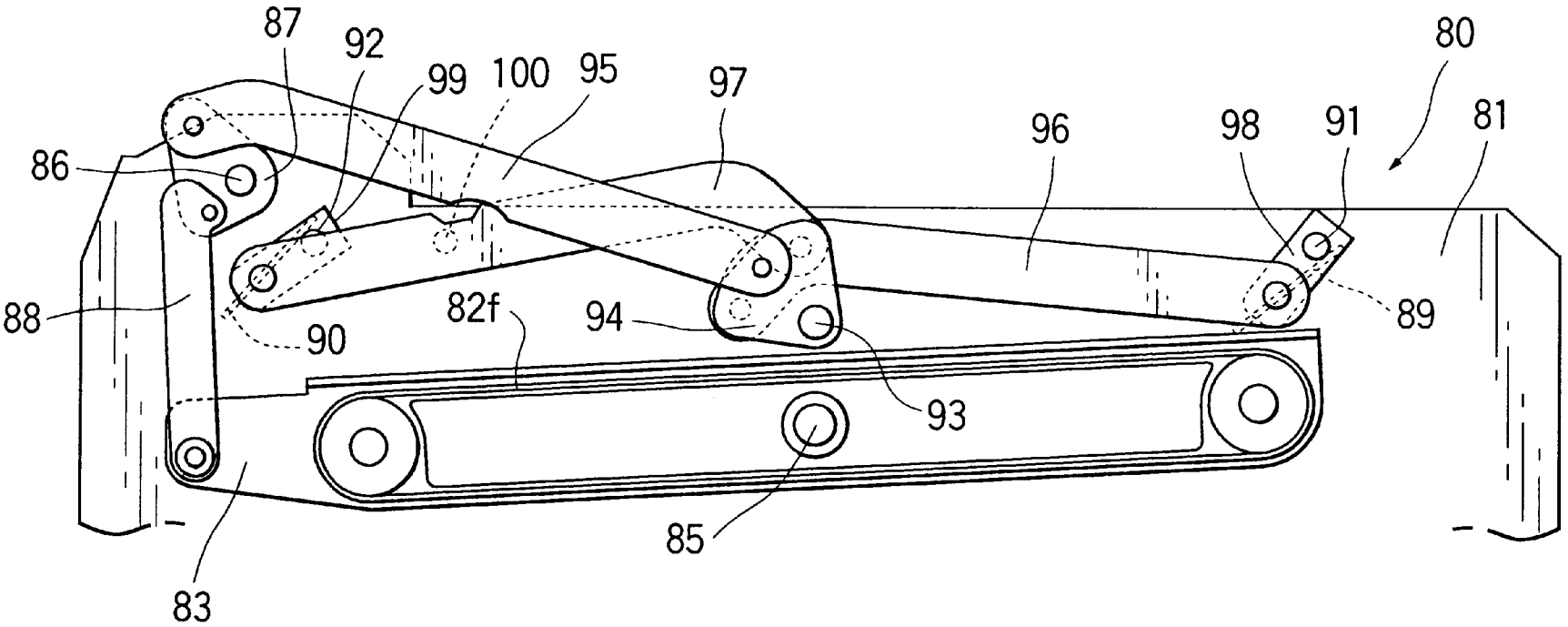
FIG. 7 is a schematic left side view of a coin temporary storing section showing it releasing coins on belt conveyors rearwardly.

FIG. 7 is a schematic left side view of the coin temporary storing section 80 showing it releasing coins on the belt conveyors 82*a*, 82*b*, 82*c*, 82*d*, 82*e* and 82*f* rearwardly. The coin receiving and dispensing machine 1 according to this embodiment is constituted so that if the operator inputs a coin receipt instruction signal through the operating section 5 after the counted value of the deposited coins counted by the coin discriminating section 47 was displayed on the display section 4, coins stored in the coin temporary storing section 80 are fed to the dispensable coin storing section 10 disposed below the rear end portion of the coin temporary storing section 80. For enabling such an operation, the dispensable coin storing section 10 having dispensable coin storing units for storing coins in accordance with their denominations is provided below the rear end portion of the coin temporary storing section 80.

As shown in FIG. 7, when the swing drive shaft 86 is rotated counterclockwise, the cam 87 is rotated counterclockwise and the link 88 is moved downwardly so that the rear end portion of the belt conveyor unit 83 is inclined downwardly. At the same time, the cam 94 is rotated counterclockwise and the support shaft 92 is rotated clockwise via the links 97 and 99, whereby the gate member 90 disposed on the rear side is moved apart from the belt conveyors 82*a*, 82*b*, 82*c*, 82*d*, 82*e* and 82*f*. Therefore, it is possible to release coins on the belt conveyors 82*a*, 82*b*, 82*c*, 82*d*, 82*e* and 82*f* rearwardly. The coins rearwardly released from the belt conveyors 82*a*, 82*b*, 82*c*, 82*d*, 82*e* and 82*f* are fed into the dispensable coin storing units of the dispensable coin storing section 10 in accordance with their denominations and stored therein.

In FIGS. 4 to 7, the reference numeral 100 designates a sensor for detecting coins dropped through the sorting opening 63 and the coin sorting openings 71*a*, 71*b*, 71*c*, 71*d*, 71*e* and 71*f*. The sensor 100 comprises a light emitting element and a light receiving element and the belt conveyors 82*a*, 82*b*, 82*c*, 82*d*, 82*e* and 82*f* are moved forwardly when light emitted from the light emitting element is intercepted by a coin dropped through the sorting opening 63 and the coin sorting openings 71*a*, 71*b*, 71*c*, 71*d*, 71*e* and 71*f*. In FIG. 4, the reference numeral 101 designates a chute for leading unacceptable coins dropped through the sorting opening 53 of the first coin sorting section 51 to the coin returning opening 6.

Figure 8:
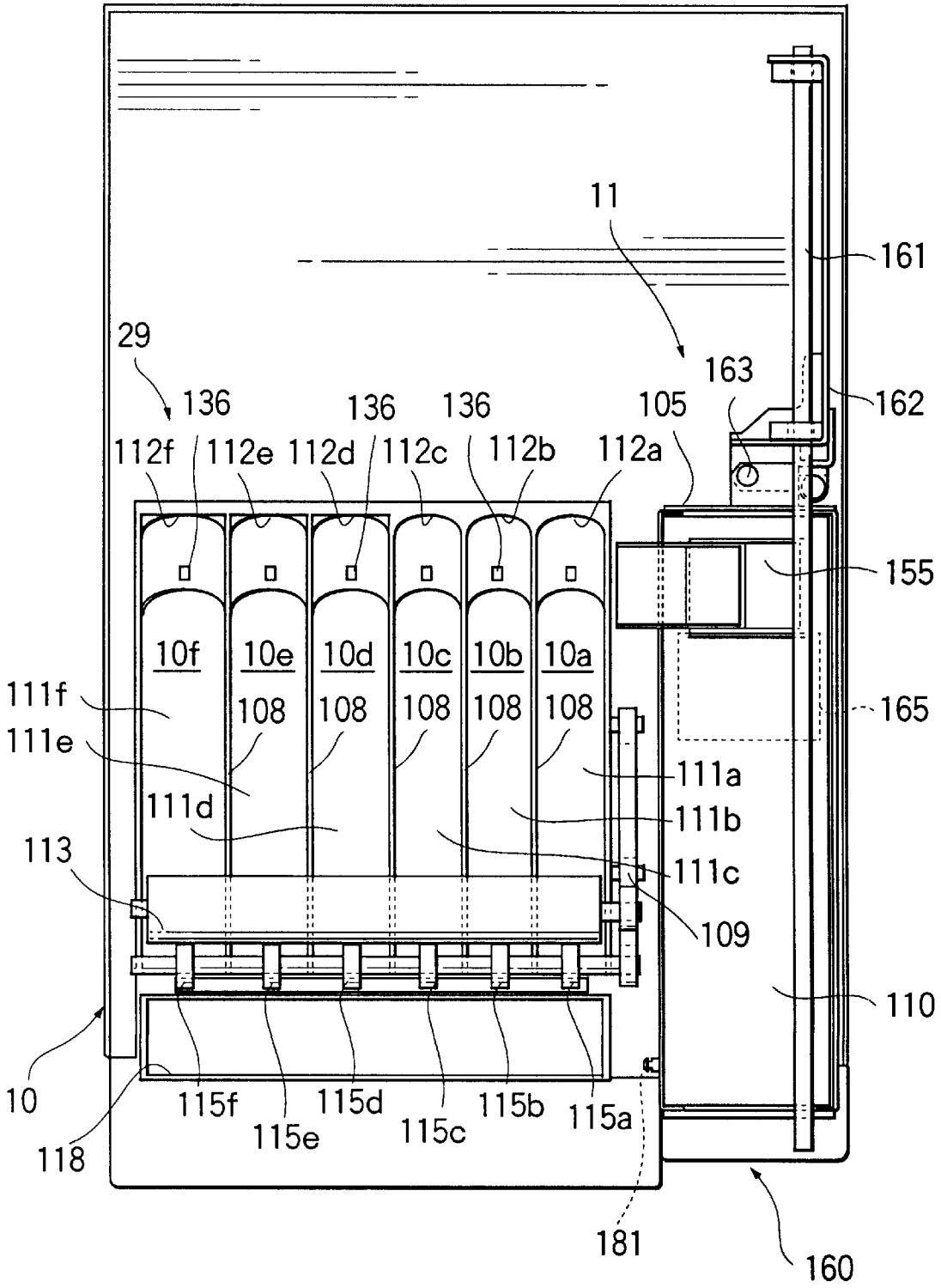
FIG. 8 is a schematic plan view of a dispensable coin storing section and a safe section.
Figure 9:
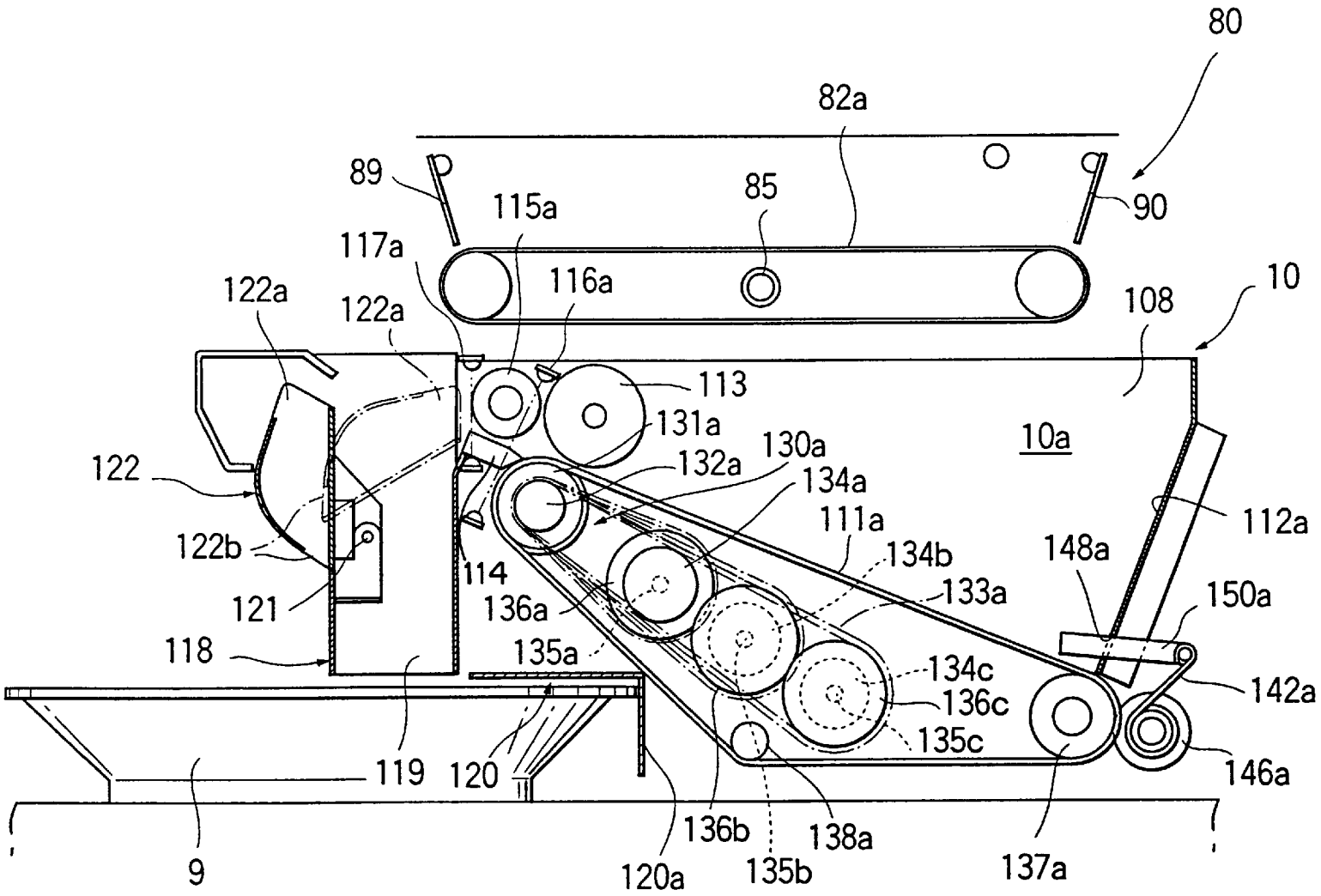
FIG. 9 is a schematic right side view of the dispensable coin storing section.

FIG. 8 is a schematic plan view of the dispensable coin storing section 10 and the safe section 11 and FIG. 9 is a schematic right side view of the dispensable coin storing section 10.

As shown in FIG. 8, the dispensable coin storing section 10 comprises dispensable coin storing units 10*a*, 10*b*, 10*c*, 10*d*, 10*e* and 10*f* for storing coins to be dispensed in accordance with their denominations. The dispensable coin storing units 10*a*, 10*b*, 10*c*, 10*d*, 10*e* and 10*f* are respectively associated with the coin temporary storing units 81*a*, 81*b*, 81*c*, 81*d*, 81*e* and 81*f* and located at positions where coins dropped from the rear end portions of the belt conveyors 82*a*, 82*b*, 82*c*, 82*d*, 82*e* and 82*f* of the coin temporary storing units 81*a*, 81*b*, 81*c*, 81*d*, 81*e* and 81*f* can be received therein.

To the contrary, coins temporarily stored in the collected coin temporary storing unit 81 and dropped from the rear end portions of the belt conveyor 82 are collected into a safe 110 via a chute 105.

The dispensable coin storing units 10*a*, 10*b*, 10*c*, 10*d*, 10*e* and 10*f* extend in the longitudinal direction and are disposed in such a manner that the rear end portions thereof are inclined downwardly. The dispensable coin storing units 10*a*, 10*b*, 10*c*, 10*d*, 10*e* and 10*f* respectively include belt conveyors 111*a*, 111*b*, 111*c*, 111*d*, 111*e* and 111*f* and the adjacent belt conveyors 111*a*, 111*b*, 111*c*, 111*d*, 111*e*, 111*f* are separated by a separation members 108. The belt conveyors 111*a*, 111*b*, 111*c*, 111*d*, 111*e* and 111*f* are independently driven by independent motors (not shown). The belt conveyors 111*a*, 111*b*, 111*c*, 111*d*, 111*e* and 111*f* are respectively provided with rear walls 112*a*, 112*b*, 112*c*, 112*d*, 112*e* and 112*f* extending rearwardly and upwardly at the rear end portions thereof. The coin temporary storing units 81*a*, 81*b*, 81*c*, 81*d*, 81*e* and 81*f* of the coin temporary storing section 80 are disposed substantially above the base portions of the rear walls 112*a*, 112*b*, 112*c*, 112*d*, 112*e* and 112*f* and the surfaces of the rear walls 112*a*, 112*b*, 112*c*, 112*d*, 112*e* and 112*f* on the side of the belt conveyors 111*a*, 111*b*, 111*c*, 111*d*, 111*e* and 111*f* are formed to be concave and cylindrical in such a manner that the cylindrical surface has an axis extending upwardly.

A reverse rotating roller 113 rotating in the opposite direction to the transport direction of the belt conveyors 111*a*, 111*b*, 111*c*, 111*d*, 111*e* and 111*f* is provided above the front end portions of the belt conveyors 111*a*, 111*b*, 111*c*, 111*d*, 111*e* and 111*f* and the clearance between the front end portions of the belt conveyors 111*a*, 111*b*, 111*c*, 111*d*, 111*e*, 111*f* and the reverse rotating roller 113 is set equal to or greater than the average thickness of coins to be handled and equal to or less than double the average thickness, preferably, 1.5 times the average thickness.

As shown in FIG. 9, in front of the belt conveyors 111*a*, 111*b*, 111*c*, 111*d*, 111*e*, 111*f*, a support plate 114 is provided for supporting coins fed out from the belt conveyors 111*a*, 111*b*, 111*c*, 111*d*, 111*e*, 111*f* so as to be located on the extension of the upper surface of the belt conveyors 111*a*, 111*b*, 111*c*, 111*d*, 111*e*, 111*f* and dispensing rollers 115*a*, 115*b*, 115*c*, 115*d*, 115*e* and 115*f* which can be rotated at higher circumference speed than the coin transport speed of the belt conveyors 111*a*, 111*b*, 111*c*, 111*d*, 111*e*, 111*f* are provided at positions above and opposite to the support plate 114. The clearances between the support plate 114 and the respective dispensing rollers 115*a*, 115*b*, 115*c*, 115*d*, 115*e*, 115*f* are set smaller than the thickness of a coin of corresponding denomination, preferably, about half of the thickness of a coin of corresponding denomination. As shown in FIG. 8, the reverse rotating roller 113 and the dispensing rollers 115*a*, 115*b*, 115*c*, 115*d*, 115*e*, 115*f* are rotated by a single common motor (not shown) via a drive belt 109.

As shown in FIG. 9, sensors 116*a*, 116*b*, 116*c*, 116*d*, 116*e*, 116*f* each including a light emitting element and a light receiving element are provided for detecting coins passing through the portion between the reverse rotating roller 113 and the dispensing rollers 115*a*, 115*b*, 115*c*, 115*d*, 115*e*, 115*f* and sensors 117*a*, 117*b*, 117*c*, 117*d*, 117*e*, 117*f* each including a light emitting element and a light receiving element are further provided in front of the respective dispensing rollers 115*a*, 115*b*, 115*c*, 115*d*, 115*e*, 115*f*.

As shown in FIGS. 8 and 9, a tube-like chute 118 is provided for leading coins downwardly in front of the support plate 114 and the dispensing rollers 115*a*, 115*b*, 115*c*, 115*d*, 115*e*, 115*f* and a coin releasing opening 119 is formed for releasing coins onto the receiving tray 9 at the lower end portion of the chute 118. The chute 118 is disposed below the front end portions of the collected coin temporary storing unit 81 and the coin temporary storing units 81*a*, 81*b*, 81*c*, 81*d*, 81*e*, 81*f* of the coin temporary storing section 80 and coins dropped from the front end portions of the collected coin temporary storing unit 81 and the coin temporary storing unit 81*a*, 81*b*, 81*c*, 81*d*, 81*e*, 81*f* can be led via the chute 118 and the coin releasing opening 119 onto the receiving tray 9 set below the coin releasing opening 119. Further, a shutter 120 is provided for closing the coin releasing opening 119 when the receiving tray 9 is not set below the coin releasing opening 119. The shutter 120 is always biased by a spring (not shown) so as to close the coin releasing opening 119 and when the receiving tray is set below the coin releasing opening 119 and an abutment portion 120*a* of the shutter 120 is pushed rearwardly by the receiving tray 9, the shutter 120 opens the coin releasing opening 119.

A shaft 121 extending in the widthwise direction is supported by the chute 118 and a collection chute 122 is supported by the shaft 121 for collecting coins stored in the dispensable coin storing units 10*a*, 10*b*, 10*c*, 10*d*, 10*e* and 10*f* into the safe 110. The collection chute 122 is swingable about the shaft 121 between its retracted position indicated by a solid line in FIG. 9 where it is spaced apart from the support plate 114 and the dispensing rollers 115*a*, 115*b*, 115*c*, 115*d*, 115*e*, 115*f* and its facing position indicated by a broken line in FIG. 9 where it is located close to and to face the support plate 114 and the dispensing rollers 115*a*, 115*b*, 115*c*, 115*d*, 115*e*, 115*f* and is always biased toward its retracted position so that the wall portion thereof forms a wall portion of the chute 118. The collection chute 122 has a coin receiving opening 122*a* which faces the support plate 114 and the dispensing rollers 115*a*, 115*b*, 115*c*, 115*d*, 115*e*, 115*f* and can receive coins when the collection chute 122 is located at its facing position. It also has a coin feed-out opening 122*b* for feeding out coins. At the completion of business, coins stored in the dispensable coin storing units 10*a*, 10*b*, 10*c*, 10*d*, 10*e*, 10*f* can be collected into the safe 110 by positioning the safe 110 in front of the coin receiving and dispensing machine 1, feeding coins into the collection chute 122 positioned at its facing position via the coin receiving opening 122*a* and feeding coins into the safe 110 via the coin feed-out opening 122*b*.

Coins stored in the thus constituted dispensable coin storing units 10*a*, 10*b*, 10*c*, 10*d*, 10*e*, 10*f* of the dispensable coin storing section 10 are dispensed onto the receiving tray 9 via the coin releasing opening 119 in the following manner.

The receiving tray 9 is first set below the coin releasing opening 119 and the reverse rotating roller 113 and the dispensing rollers 115*a*, 115*b*, 115*c*, 115*d*, 115*e*, 115*f* are driven by a motor (not shown).

One of the belt conveyors 111*a*, 111*b*, 111*c*, 111*d*, 111*e*, 111*f* corresponding to coins of the denomination to be dispensed is then driven and coins on the belt conveyors 111*a*, 111*b*, 111*c*, 111*d*, 111*e*, 111*f* are conveyed forwardly toward the reverse rotating roller 113. When coins stacked on the belt conveyors 111*a*, 111*b*, 111*c*, 111*d*, 111*e*, 111*f* reach the reverse rotating roller 113, coins except the lowermost coin are sent back on the belt conveyors 111*a*, 111*b*, 111*c*, 111*d*, 111*e*, 111*f* by the reverse rotating roller 113 and only the lowermost coin is fed toward the support plate 114. Therefore, coins are fed from the belt conveyors 111*a*, 111*b*, 111*c*, 111*d*, 111*e*, 111*f* onto the support plate 114 one by one. Coins fed onto the support plate 114 are detected by one of the sensors 116*a*, 116*b*, 116*c*, 116*d*, 116*e*, 116*f* and the number thereof is counted.

Each of the coins fed onto the support plate 114 one by one is accelerated by the dispensing rollers 115*a*, 115*b*, 115*c*, 115*d*, 115*e*, 115*f* and fed into the chute 118 to fall within the chute so that it is dispensed onto the receiving tray 9 via the coin releasing opening 119. At this time, the coin is detected by one of the sensors 117*a*, 117*b*, 117*c*, 117*d*, 117*e*, 117*f* and counted.

When the one of the sensors 116*a*, 116*b*, 116*c*, 116*d*, 116*e*, 116*f* has detected coins in the number predetermined in advance, the belt conveyor 111*a*, 111*b*, 111*c*, 111*d*, 111*e*, 111*f* corresponding to coins of the denomination is stopped. In the case where coins of two or more denominations are to be dispensed, a next belt conveyor 111*a*, 111*b*, 111*c*, 111*d*, 111*e*, 111*f* corresponding to coins of another denomination is driven, whereby coins of the denomination are dispensed onto the receiving tray 9 via the coin releasing opening 119 in the same manner.

When the predetermined numbers of coins of the respective denominations have been dispensed, the reverse rotating roller 113 and the dispensing rollers 115*a*, 115*b*, 115*c*, 115*d*, 115*e*, 115*f* are stopped, thereby completing the coin dispensing operation.

Figure 10:
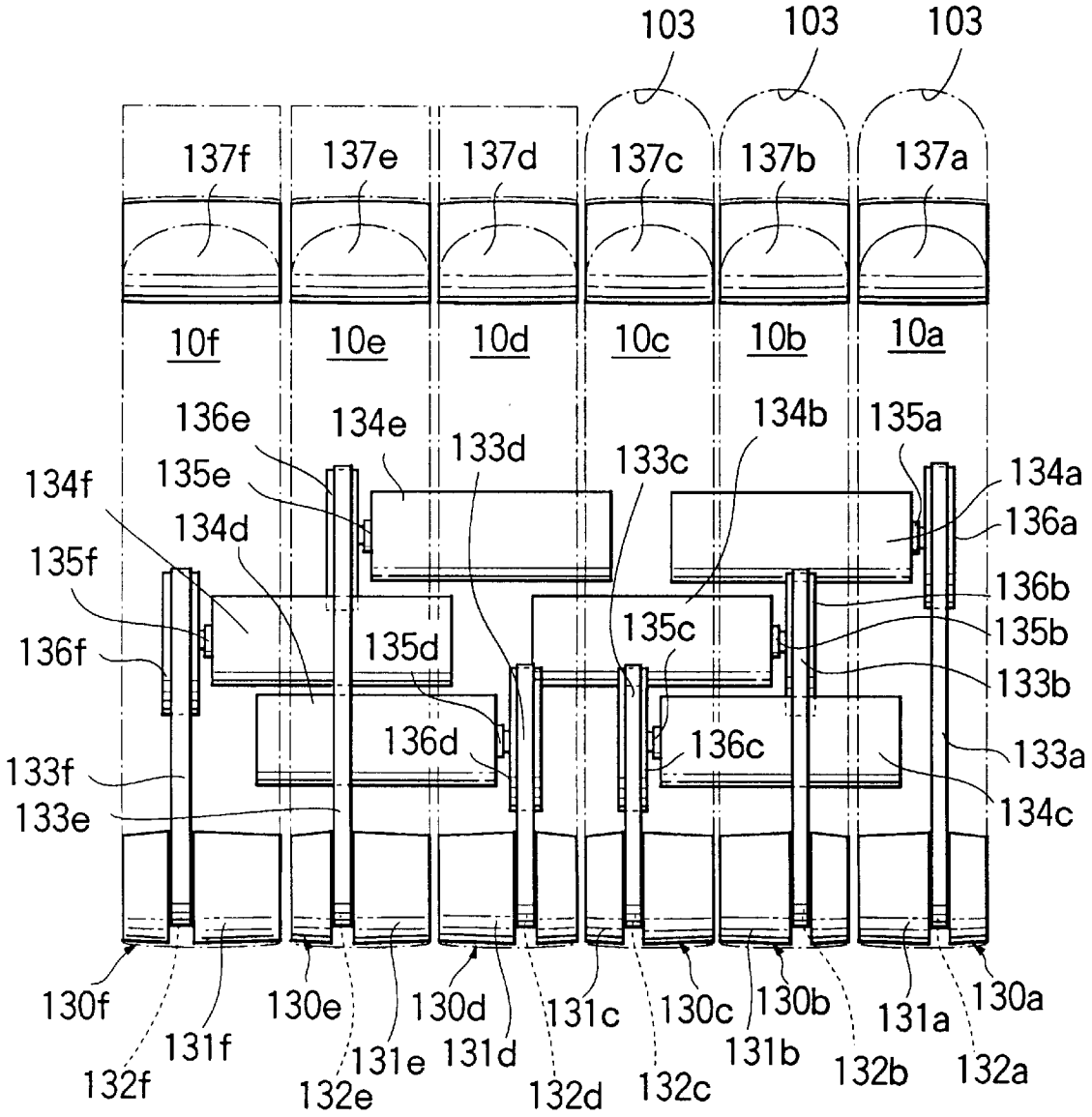
FIG. 10 is a schematic partial plan view of a drive mechanism for belt conveyors of dispensable coin storing units.

FIG. 10 is a schematic partial plan view of a drive mechanism for the belt conveyors 111*a*, 111*b*, 111*c*, 111*d*, 111*e*, 111*f* of the dispensable coin storing units 10*a*, 10*b*, 10*c*, 10*d*, 10*e*, 10*f*.

As shown in FIG. 10, each of rollers 130*a*, 130*b*, 130*c*, 130*d*, 130*e*, 130*f* around which an associated one of the belt conveyors 111*a*, 111*b*, 111*c*, 111*d*, 111*e*, 111*f* is wound at the front portion of the coin receiving and dispensing machine 1 is divided into two large diameter portions 131*a*, 131*b*, 131*c*, 131*d*, 131*e*, 131*f* and a small diameter portion 132*a*, 132*b*, 132*c*, 132*d*, 132*e*, 132*f* between the two large diameter portions 131*a*, 131*b*, 131*c*, 131*d*, 131*e*, 131*f*. The belt conveyors 111*a*, 111*b*, 111*c*, 111*d*, 111*e*, 111*f* are respectively supported by the two large diameter portions 131*a*, 131*b*, 131*c*, 131*d*, 131*e*, 131*f* and drive belts 133*a*, 133*b*, 133*c*, 133*d*, 133*e*, 133*f* are wound around the small diameter portion 132*a*, 132*b*, 132*c*, 132*d*, 132*e*, 132*f*. Each of the drive belts 133*a*, 133*b*, 133*c*, 133*d*, 133*e*, 133*f* is also wound around a drive roller 136*a*, 136*b*, 136*c*, 136*d*, 136*e* or 136*f* fixed to an output shaft 135*a*, 135*b*, 135*c*, 135*d*, 135*e* or 135*f* of a motor 134*a*, 134*b*, 134*c*, 134*d*, 134*e* or 134*f* and the driving force of the motor 134*a*, 134*b*, 134*c*, 134*d*, 134*e* or 134*f* is transmitted to the associated belt conveyor 111*a*, 111*b*, 111*c*, 111*d*, 111*e* or 111*f* via the output shaft 135*a*, 135*b*, 135*c*, 135*d*, 135*e* or 135*f*, the drive roller 136*a*, 136*b*, 136*c*, 136*d*, 136*e* or 136*f* and the drive belt 133*a*, 133*b*, 133*c*, 133*d*, 133*e* or 133*f*. The motors 134*a*, 134*b*, 134*c*, 134*d*, 134*e* and 134*f* can be driven independently of each other.

As shown in FIG. 9, the belt conveyors 111*a*, 111*b*, 111*c*, 111*d*, 111*e*, 111*f* are further wound around rollers 137*a*, 137*b*, 137*c*, 137*d*, 137*e*, 137*f* and rollers 138*a*, 138*b*, 138*c*, 138*d*, 138*e*, 138*f* (only the roller 138*a* is shown) and the motors 134*a*, 134*b*, 134*c*, 134*d*, 134*e*, 134*f* are disposed inside of the belt conveyors 111*a*, 111*b*, 111*c*, 111*d*, 111*e*, 111*f* in a staggered arrangement as shown in FIG. 10.

Figure 11:
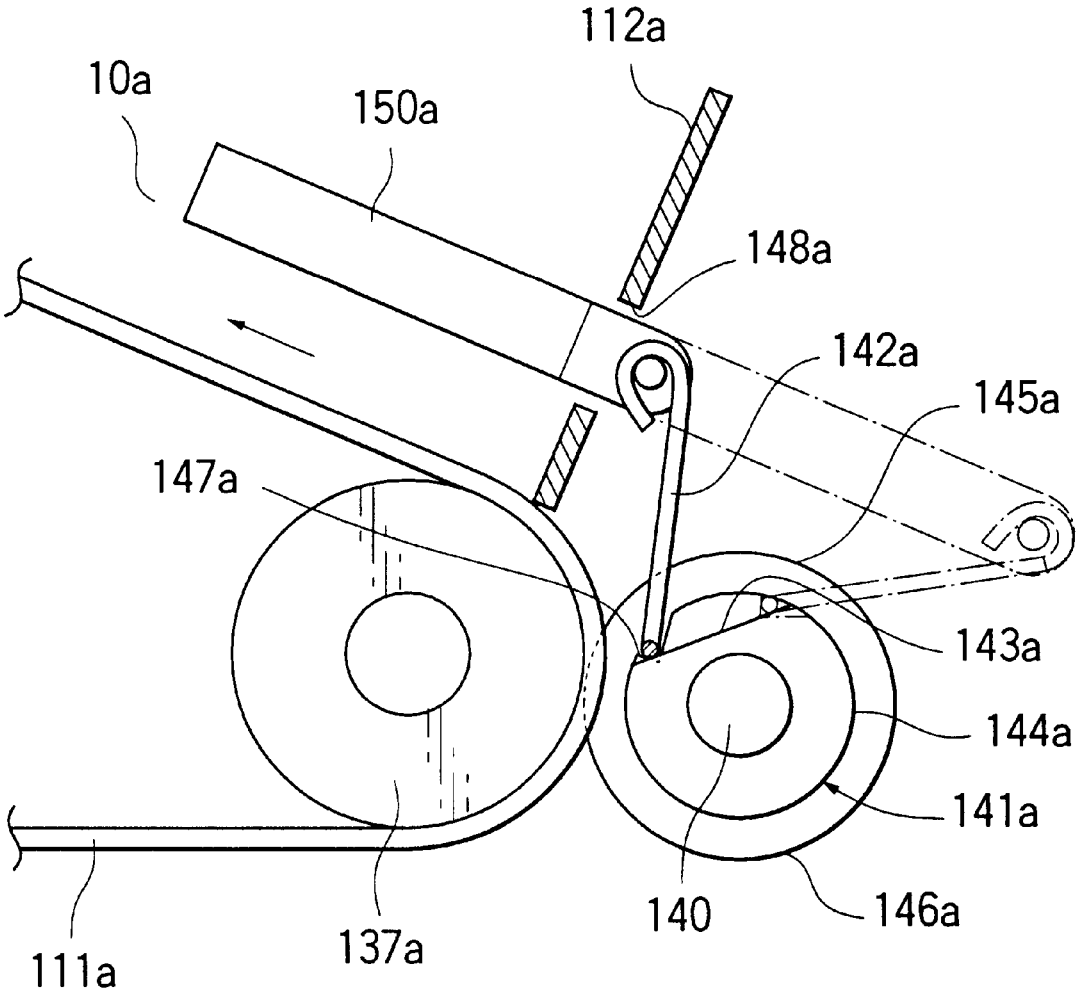
FIG. 11 is a schematic right side view of a mechanism for preventing coins dropped onto belt conveyors from being held to erect at the rear and lower end portions of the belt conveyors.
Figure 12:
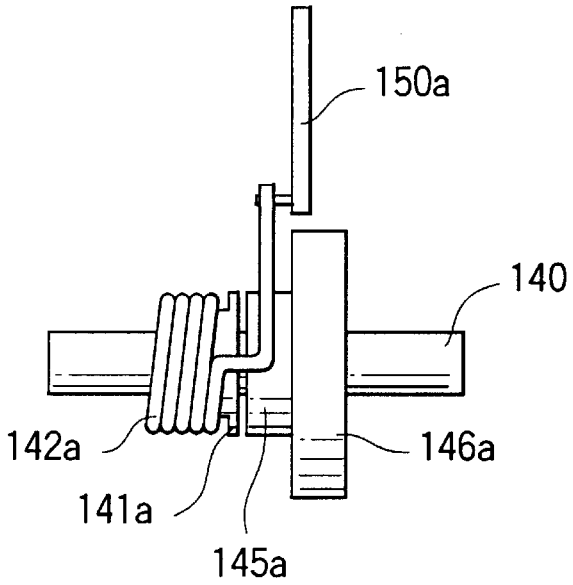
FIG. 12 is a schematic right side view of FIG. 11.

FIG. 11 is a schematic right side view of a mechanism for preventing coins dropped onto the belt conveyors 111*a*, 111*b*, 111*c*, 111*d*, 111*e*, 111*f* from being held erect at the rear and lower end portions of the belt conveyors 111*a*, 111*b*, 111*c*, 111*d*, 111*e*, 111*f* and FIG. 12 is a schematic right side view of FIG. 11.

Figure 13:
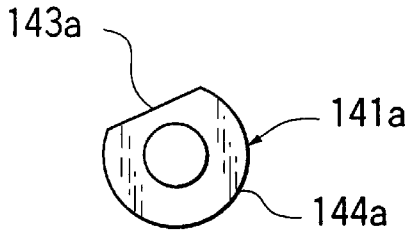
FIG. 13 is a schematic side view showing the shape of a cam.
Figure 14:
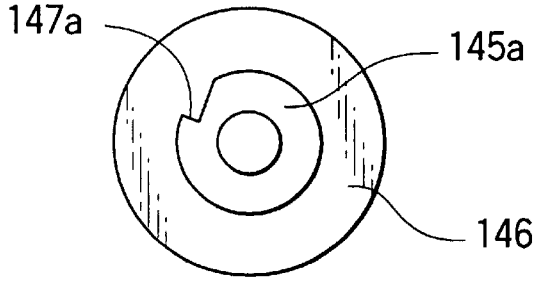
FIG. 14 is a schematic side view showing the shapes of a ratchet roller and a driven roller.

As shown in FIGS. 11 and 12, a support shaft 140 is fixed to the body of the coin receiving and dispensing machine 1 behind the rollers 137*a*, 137*b*, 137*c*, 137*d*, 137*e*, 137*f* and cams 141*a*, 141*b*, 141*c*, 141*d*, 141*e*, 141*f* and end portions of torsion springs 142*a*, 142*b*, 142*c*, 142*d*, 142*e*, 142*f* are fixed to the support shaft 140. As shown in FIG. 13, each of the cams 141*a*, 141*b*, 141*c*, 141*d*, 141*e*, 141*f* includes a cut portion 143*a*, 143*b*, 143*c*, 143*d*, 143*e*, 143*f* and a circle portion 144*a*, 144*b*, 144*c*, 144*d*, 144*e*, 144*f*. Further, ratchet rollers 145*a*, 145*b*, 145*c*, 145*d*, 145*e*, 145*f* are rotatably mounted on the support shaft 140 and driven rollers 146*a*, 146*b*, 146*c*, 146*d*, 146*e*, 146*f*, which are integrally formed with the ratchet rollers 145*a*, 145*b*, 145*c*, 145*d*, 145*e*, 145*f*, are in friction contact with the circumferences of the belt conveyors 111*a*, 111*b*, 111*c*, 111*d*, 111*e*, 111*f* wound around the rollers 137*a*, 137*b*, 137*c*, 137*d*, 137*e*, 137*f* and are rotated in accordance with the movement of the belt conveyors 111*a*, 111*b*, 111*c*, 111*d*, 111*e*, 111*f*. As shown in FIG. 14, the ratchet rollers 145*a*, 145*b*, 145*c*, 145*d*, 145*e*, 145*f* are further formed with cut portions 147*a*, 147*b*, 147*c*, 147*d*, 147*e*, 147*f* engageable with end portions of the torsion springs 142*a*, 142*b*, 142*c*, 142*d*, 142*e*, 142*f*.

The torsion springs 142*a*, 142*b*, 142*c*, 142*d*, 142*e*, 142*f* extend upwardly and the rear end portions of projecting members 150*a*, 150*b*, 150*c*, 150*d*, 150*e*, 150*f* projectable into the dispensable coin storing units 10*a*, 10*b*, 10*c*, 10*d*, 10*e*, 10*f* through openings 148*a*, 148*b*, 148*c*, 148*d*, 148*e*, 148*f* formed in the rear walls 112*a*, 112*b*, 112*c*, 112*d*, 112*e*, 112*f* are connected to the upper end portions of the torsion springs 142*a*, 142*b*, 142*c*, 142*d*, 142*e*, 142*f*.

Therefore, when the belt conveyors 111*a*, 111*b*, 111*c*, 111*d*, 111*e*, 111*f* are moved, the driven rollers 146*a*, 146*b*, 146*c*, 146*d*, 146*e*, 146*f* in friction contact therewith are rotated, thereby rotating the ratchet rollers 145*a*, 145*b*, 145*c*, 145*d*, 145*e*, 145*f*. As a result, when the cut portions 147*a*, 147*b*, 147*c*, 147*d*, 147*e*, 147*f* formed in the ratchet rollers 145*a*, 145*b*, 145*c*, 145*d*, 145*e*, 145*f* reach the cut portions 143*a*, 143*b*, 143*c*, 143*d*, 143*e*, 143*f* of the cams 141*a*, 141*b*, 141*c*, 141*d*, 141*e*, 141*f*, the cut portions 147*a*, 147*b*, 147*c*, 147*d*, 147*e*, 147*f* engage with the end portions of the torsion springs 142*a*, 142*b*, 142*c*, 142*d*, 142*e*, 142*f* located at positions indicated by solid lines in FIG. 11, thereby swinging the torsion springs 142*a*, 142*b*, 142*c*, 142*d*, 142*e*, 142*f* clockwise in FIG. 11 so as to move the projecting members 150*a*, 150*b*, 150*c*, 150*d*, 150*e*, 150*f* projecting into the dispensable coin storing units 10*a*, 10*b*, 10*c*, 10*d*, 10*e*, 10*f* through the openings 148*a*, 148*b*, 148*c*, 148*d*, 148*e*, 148*f* formed in the rear walls 112*a*, 112*b*, 112*c*, 112*d*, 112*e*, 112*f* rearwardly to positions indicated by broken lines in FIG. 11.

When the projecting members 150*a*, 150*b*, 150*c*, 150*d*, 150*e*, 150*f* are moved to the positions indicated by the broken lines in FIG. 11, the cut portions 147*a*, 147*b*, 147*c*, 147*d*, 147*e*, 147*f* formed in the ratchet rollers 145*a*, 145*b*, 145*c*, 145*d*, 145*e*, 145*f* reach the circle portion 144*a*, 144*b*, 144*c*, 144*d*, 144*e*, 144*f* of the cams 141*a*, 141*b*, 141*c*, 141*d*, 141*e*, 141*f*, thereby releasing the engagement between the cut portions 147*a*, 147*b*, 147*c*, 147*d*, 147*e*, 147*f* formed in the ratchet rollers 145*a*, 145*b*, 145*c*, 145*d*, 145*e*, 145*f* and the end portions of the torsion springs 142*a*, 142*b*, 142*c*, 142*d*, 142*e*, 142*f* so that the torsion springs 142*a*, 142*b*, 142*c*, 142*d*, 142*e*, 142*f* return to positions indicated by the solid lines in FIG. 11 by their own biasing force. As a result, the projecting members 150*a*, 150*b*, 150*c*, 150*d*, 150*e*, 150*f* project into the dispensable coin storing units 10*a*, 10*b*, 10*c*, 10*d*, 10*e*, 10*f* through the openings 148*a*, 148*b*, 148*c*, 148*d*, 148*e*, 148*f* formed in the rear walls 112*a*, 112*b*, 112*c*, 112*d*, 112*e*, 112*f*.

Therefore, even in the case where coins dropped from the coin temporary storing units 81*a*, 81*b*, 81*c*, 81*d*, 81*e*, 81*f* of the coin temporary storing section 80 onto the belt conveyors 111*a*, 111*b*, 111*c*, 111*d*, 111*e*, 111*f* of the dispensable coin storing units 10*a*, 10*b*, 10*c*, 10*d*, 10*e*, 10*f* stand erect along the rear walls 112*a*, 112*b*, 112*c*, 112*d*, 112*e*, 112*f*, it is possible push the coins over to lie flat on the belt conveyors 111*a*, 111*b*, 111*c*, 111*d*, 111*e*, 111*f*. Since, as described above, the surfaces of the rear walls 112*a*, 112*b*, 112*c*, 112*d*, 112*e* and 112*f* on the side of the belt conveyors 111*a*, 111*b*, 111*c*, 111*d*, 111*e* and 111*f* are formed to be concave and cylindrical in such a manner that the cylindrical surface has an axis extending upwardly in this embodiment, coins pushed over lie along the concave and cylindrical surfaces of the rear walls 112*a*, 112*b*, 112*c*, 112*d*, 112*e* and 112*f* at substantially the center portions of the belt conveyors 111*a*, 111*b*, 111*c*, 111*d*, 111*e*, 111*f*.

Figure 15:
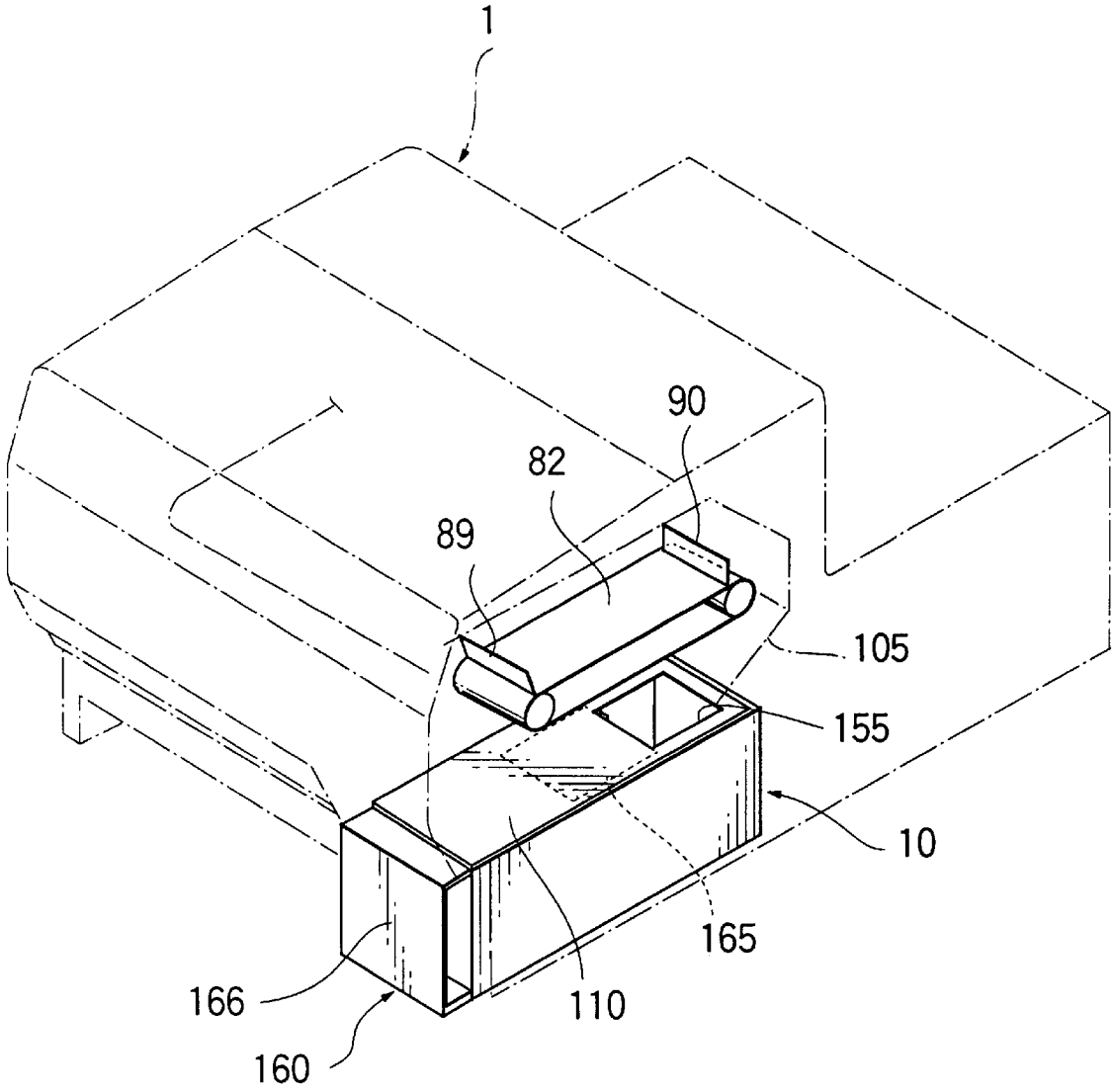
FIG. 15 is a schematic perspective view of a safe.

FIG. 15 is a schematic perspective view of the safe 110.

The safe 110 is adapted to collect coins fed from the second coin sorting section 61 of the first coin sorting passage 50 into the collected coin temporary storing unit 81 of the coin temporary storing section 80 and temporarily stored therein and coins stored in the dispensable coin storing units 10*a*, 10*b*, 10*c*, 10*d*, 10*e*, 10*f* in accordance with their denominations at the completion of business and is shaped to be substantially rectangular parallelepiped.

When coins temporarily stored in the collected coin temporary storing unit 81 of the coin temporary storing section 80 are to be collected into the safe 110, the belt conveyor unit 83 is swung rearwardly about the support shaft 85 to open the gate member 90 so that coins on the belt conveyor 82 fall in the chute 105 and are accommodated in the safe 110 through a substantially rectangular coin receiving opening 155 formed on the upper surface of the safe 110.

The safe section 11 comprises a safe accommodating box 160 which can be drawn to the front side of the coin receiving and dispensing machine 1 and the safe 110 is detachably accommodated in the safe accommodating box 160 from the upper side.

As shown in FIG. 8, a shaft 161 extending in the longitudinal direction of the coin receiving and dispensing machine 1 is fixed to the right side of the coin receiving and dispensing machine 1 and a support member 162 is slidably mounted on the shaft 161. A support shaft 163 is mounted on the support member 162 and the safe accommodating box 160 is swingably supported by the support shaft 163. Therefore, the safe accommodating box 160 can be drawn along the shaft 161 to the front side of the coin receiving and dispensing machine 1 and can be positioned in front of the coin receiving and dispensing machine 1 by swinging it about the support shaft 163.

The coin receiving opening 155 formed on the upper surface of the safe 110 is normally closed by a shutter 165 and only when the safe accommodating box 160 accommodating the safe 110 is located at a predetermined position in the safe section 11 where the safe 110 can receive coins, the lock of the shutter 165 by a lock mechanism (not shown) is released and the coin receiving opening 155 is opened.

A spring (not shown) is provided on the upper surface of the bottom of the safe 110 to be positioned on the rear side when the safe accommodating box 160 accommodating the safe 110 is located at the predetermined position in the safe section 11 and the safe 110 is provided with a swingable bottom plate (not shown) on the spring. Thus, coins dropped through the coin receiving opening 155 into the safe 110 can be prevented from remaining at the rear portion of the safe 110 and as the number of coins stored in the safe 110 increases, the bottom plate is lowered against the spring force of the spring due to the weight of stored coins, whereby the required number of coins can be accommodated in the safe 110. In FIG. 15, the reference numeral 166 designates a handle provided on the front surface of the safe accommodating box 160.

When business has been completed and coins stored in the dispensable coin storing units 10*a*, 10*b*, 10*c*, 10*d*, 10*e*, 10*f* are to be collected into the safe 110, the safe accommodating box 160 is positioned in front of the coin receiving and dispensing machine 1.

Figure 16:
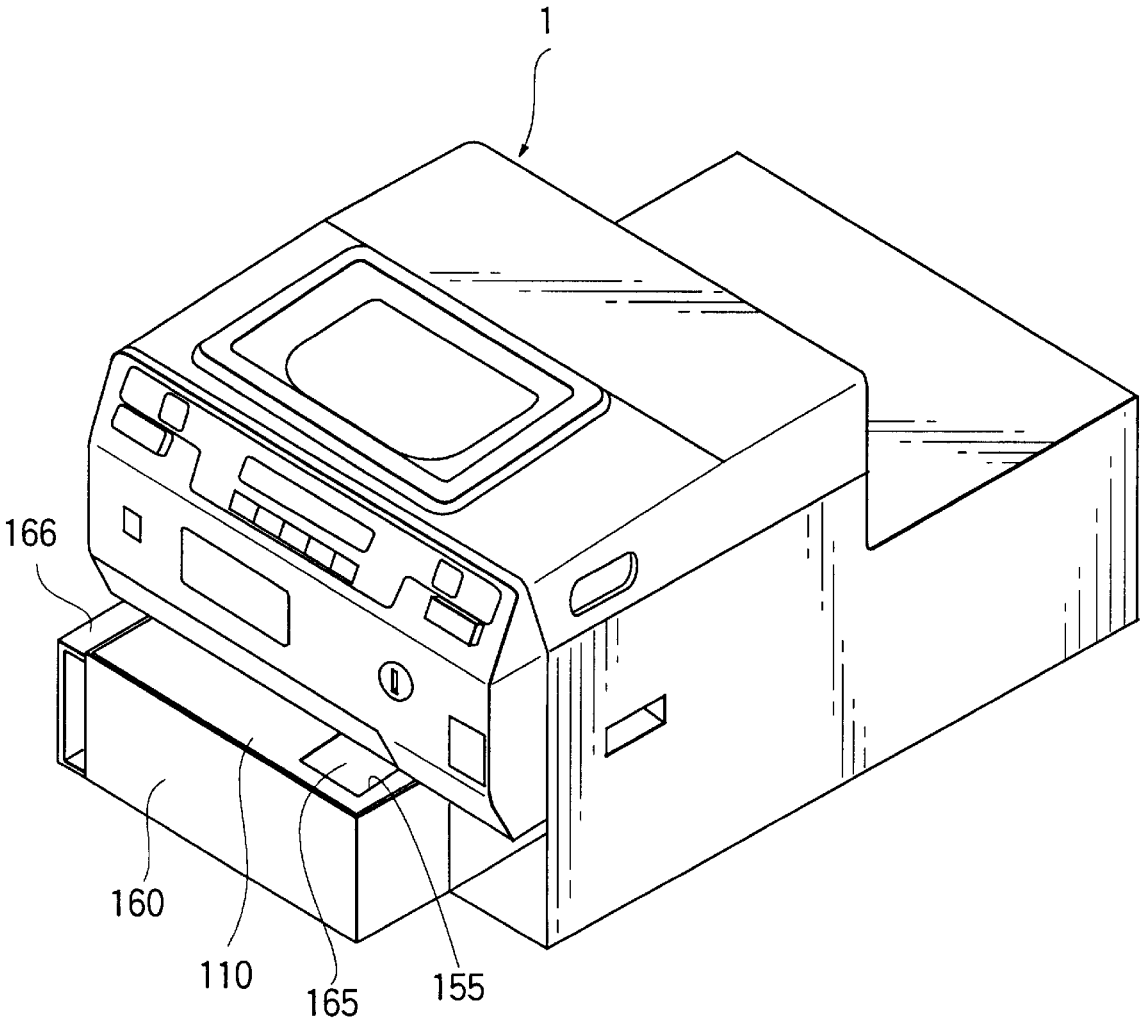
FIG. 16 is a schematic perspective view of a safe accommodating box positioned in front of a coin receiving and dispensing machine.

FIG. 16 is a schematic perspective view showing the safe accommodating box 160 positioned in front of the coin receiving and dispensing machine 1.

When coins stored in the dispensable coin storing units 10*a*, 10*b*, 10*c*, 10*d*, 10*e*, 10*f* are to be collected into the safe 110, the safe accommodating box 160 is drawn along the shaft 161 to a predetermined position on the front side of the coin receiving and dispensing machine 1 and then swung along the support shaft 163 until it abuts against the front surface of the coin receiving and dispensing machine 1. When a sensor (not shown) detects that the safe accommodating box 160 has come into abutment with the front surface of the coin receiving and dispensing machine 1, the safe accommodating box 160 is locked.

Figure 17:
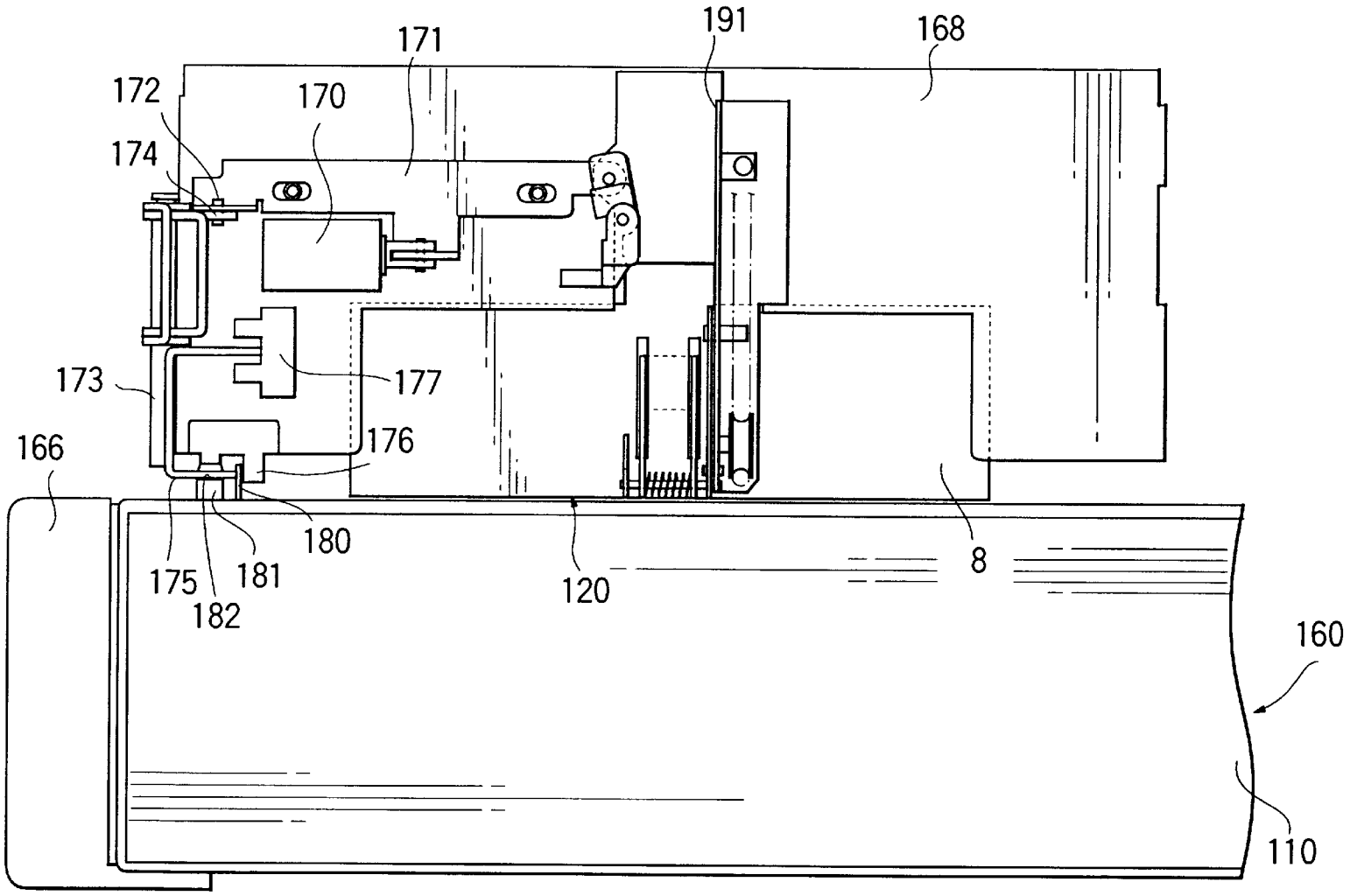
FIG. 17 is a schematic plan view of a safe locking mechanism for locking a safe accommodating box.

FIG. 17 is a schematic plan view of a safe locking mechanism for locking the safe accommodating box 160.

As shown in FIG. 17, the safe locking mechanism includes a solenoid 170 provided on a dispensing opening cover 168 forming the coin dispensing opening 8 and a slide member 171 fixed to the solenoid 170 and movable in the widthwise direction. A support shaft 172 is provided at the left end portion of the slide member 171 in FIG. 17 and one end portion of a connecting member 174 swingably supported by a support shaft 173 extending in the longitudinal direction is connected to the support shaft 172. The slide member 171 is biased by a spring (not shown) to the right in FIG. 17. A safe locking member 175 is swingably mounted on the front end portion of the support shaft 173. A sensor 176 is provided on the front surface of the coin receiving and dispensing machine 1 in the vicinity of the front end portion of the safe locking member 175.

On the other hand, the side surface of the safe accommodating box 160 to abut against the coin receiving and dispensing machine 1 is formed with detection piece 180 and a lock pin 181 projecting from the side surface, and the upper surface of the lock pin 181 is formed with a groove 182.

Figure 18:
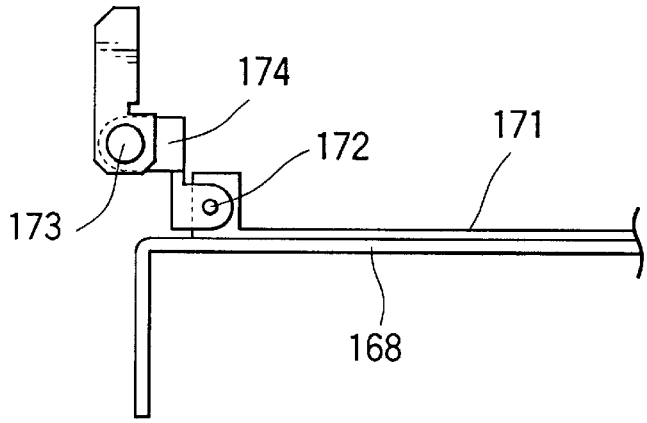
FIG. 18 is a schematic partial front view of a mechanism in the vicinity of a connecting member of the safe locking mechanism.
Figure 19:
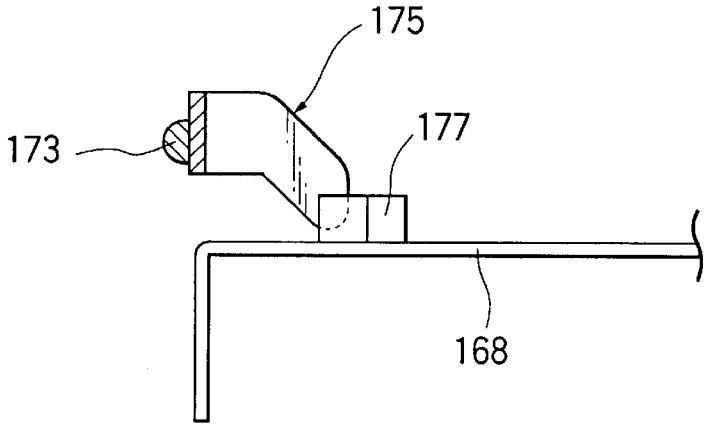
FIG. 19 is a schematic partial front view of a mechanism in the vicinity of the rear end portion of a safe locking member.
Figure 20:
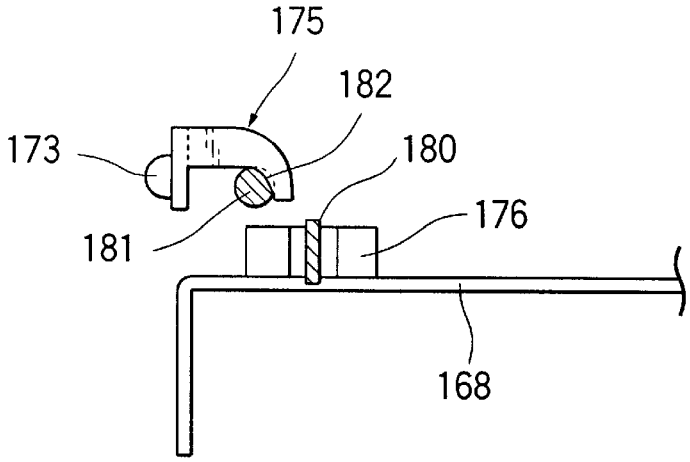
FIG. 20 is a schematic partial front view of a mechanism in the vicinity of the front end portion of a safe locking member.

FIG. 18 is a schematic partial front view of a mechanism in the vicinity of the connecting member 174 of the safe locking mechanism, FIG. 19 is a schematic partial front view of a mechanism in the vicinity of the rear end portion of the safe locking member 175 and FIG. 20 is a schematic partial front view of a mechanism in the vicinity of the front end portion of the safe locking member 175.

When the safe accommodating box 160 is brought into abutment against the front surface of the coin receiving and dispensing machine 1 in order to be locked, the sensor 176 detects the detection piece 180 provided on the safe accommodating box 160, whereby it is confirmed that the safe accommodating box 160 has come into abutment with the front surface of the coin receiving and dispensing machine 1. The solenoid 170 is then driven. When the solenoid 170 is driven, the slide member 171 is moved against the force of the spring to the left in FIG. 17 and the connecting member 174 is swung about the support shaft 173 clockwise in FIG. 18. As a result, the safe locking member 175 mounted on the support shaft 173 is swung clockwise in FIG. 20 and comes into engagement with the groove 182 formed on the upper surface of the lock pin 181 provided on the side surface of the safe accommodating box 160. It is detected by a sensor 177 provided on the dispensing opening cover 168 for detecting the rear end portion of the safe locking member 175 that the safe locking member 175 and the groove 182 of the lock pin 181 have engaged with each other.

Figure 21:
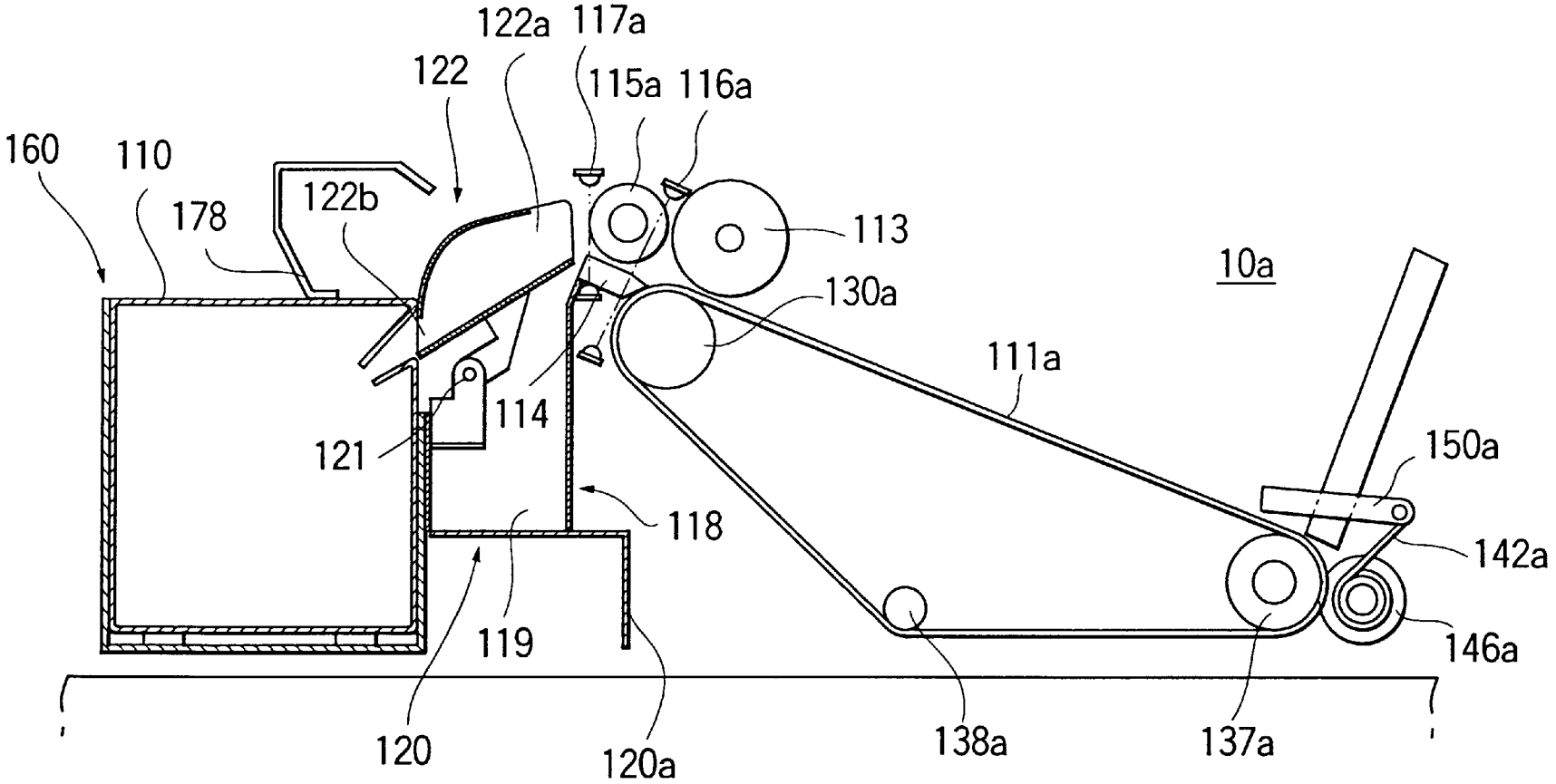
FIG. 21 is a schematic right side view of a safe accommodating box abutting against and locked on the front surface of a coin receiving and dispensing machine, shown together with a dispensable coin storing section.

FIG. 21 is a schematic right side view of the safe accommodating box 160 abutting against and locked on the front surface of the coin receiving and dispensing machine 1, together with the dispensable coin storing section 10.

When the safe accommodating box 160 is locked on the front surface of the coin receiving and dispensing machine 1, the safe 110 is pressed downwardly by a press member 178 and can be prevented from being taken out from the safe accommodating box 160.

When business has been completed, the collection chute 122 is located at its facing position where it is located close to and faces the support plate 114 and the dispensing rollers 115*a*, 115*b*, 115*c*, 115*d*, 115*e*, 115*f* and the respective belt conveyors 111*a*, 111*b*, 111*c*, 111*d*, 111*e*, 111*f* are simultaneously driven so that coins stored in the dispensable coin storing units 10*a*, 10*b*, 10*c*, 10*d*, 10*e*, 10*f* are fed into the collecting chute 122 via the coin receiving opening 122*a*, whereby the coins are fed into the safe 110 via the coin feed-out opening 122*b*.

When all coins stored in the dispensable coin storing units 10*a*, 10*b*, 10*c*, 10*d*, 10*e*, 10*f* have been fed into the safe 110, the solenoid 170 is deenergized and the slide plate 171 is moved by the spring (not shown) to the right in FIG. 17. As a result, the engagement between the safe locking member 175 and the groove 182 of the lock pin 181 is released and the safe accommodating box 160 can be moved apart from the front surface of the coin receiving and dispensing machine 1. Therefore, the safe accommodating box 160 is swung about the support shaft 163 and the safe 110 can be taken out from the safe accommodating box 160.

Figure 22:
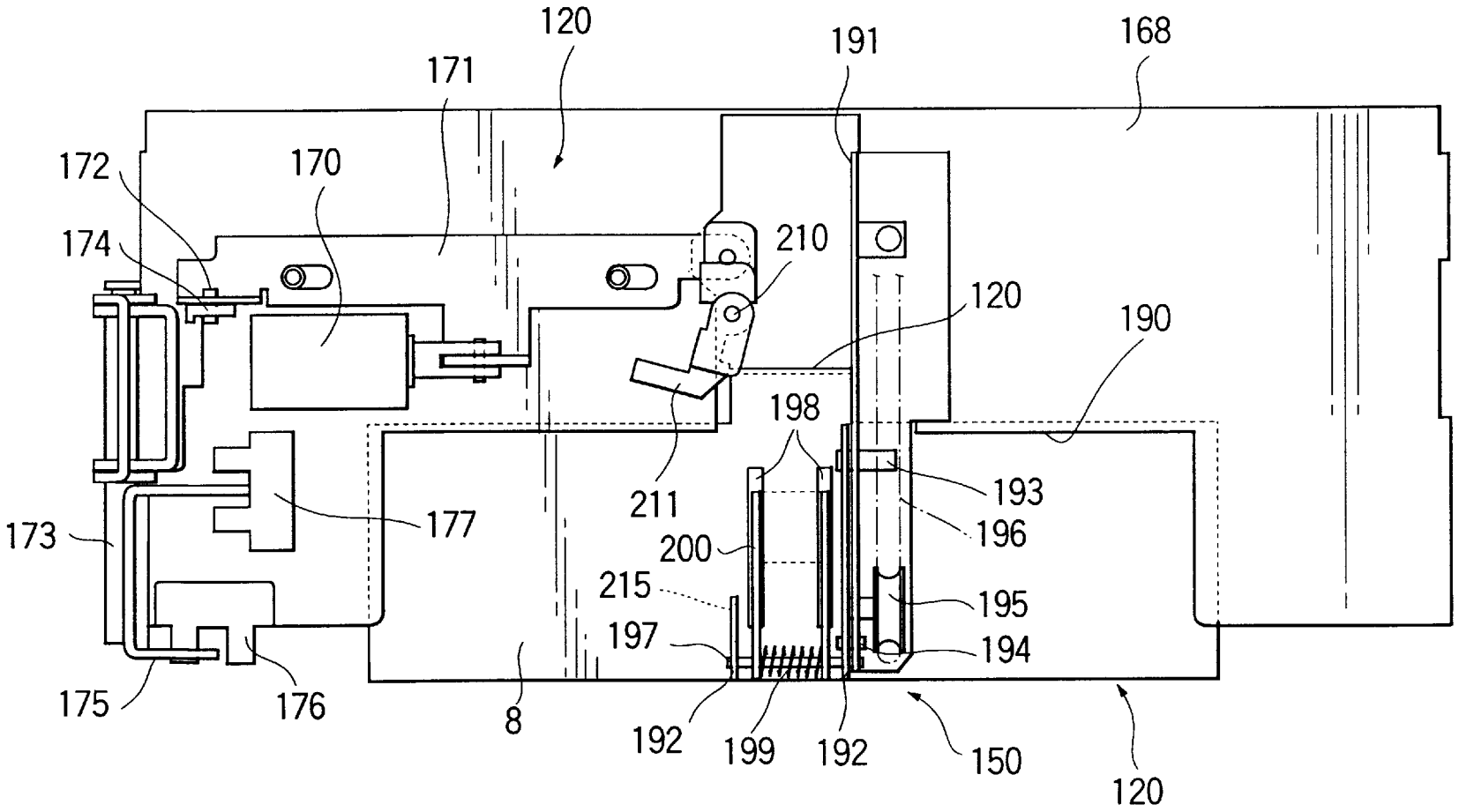
FIG. 22 is a schematic plan view of a shutter locking mechanism for locking a shutter for opening and closing a coin releasing opening of a chute to keep the coin releasing opening open and a receiving tray movement restricting mechanism for restricting the movement of a receiving tray inserted into a coin dispensing opening.

FIG. 22 is a schematic plan view of a shutter locking mechanism for locking the shutter 120 for opening and closing the coin releasing opening 119 of the chute 118 to keep the coin releasing opening 119 open and a receiving tray movement restricting mechanism for restricting the movement of the receiving tray 9 inserted into the coin dispensing opening 8.

As shown in FIG. 22, the dispensing opening cover 168 is formed with a cut portion 190 forming the coin dispensing opening 8 at substantially the center portion of the front side of the coin receiving and dispensing machine 1 and substantially the central portion of the dispensing opening cover 168 is formed with a slide guide 191. The slide guide 191 is formed with two slots (not shown) extending in the longitudinal direction and having lengths equal to the stroke of the shutter 120 for opening and closing the coin releasing opening 119 of the chute 118 and guide pins 193, 194 of a mounting member 192 are respectively inserted into the two slots. The shutter 120 for opening and closing the coin releasing opening 119 of the chute 118 is fixed to substantially the center portion of the mounting member 192.

In the vicinity of the front end portion of the slide guide 191, a pulley 195 rotatable about a widthwise axis is provided. A spring 196 whose one end portion is fixed to the slide guide 191 is wound around the pulley 195 and the other end portion of the spring 196 is fixed to the guide pin 193 of the mounting member 192 so that the mounting member 192 and, therefore, the shutter 120 is constantly biased to the front side.

Figure 23:
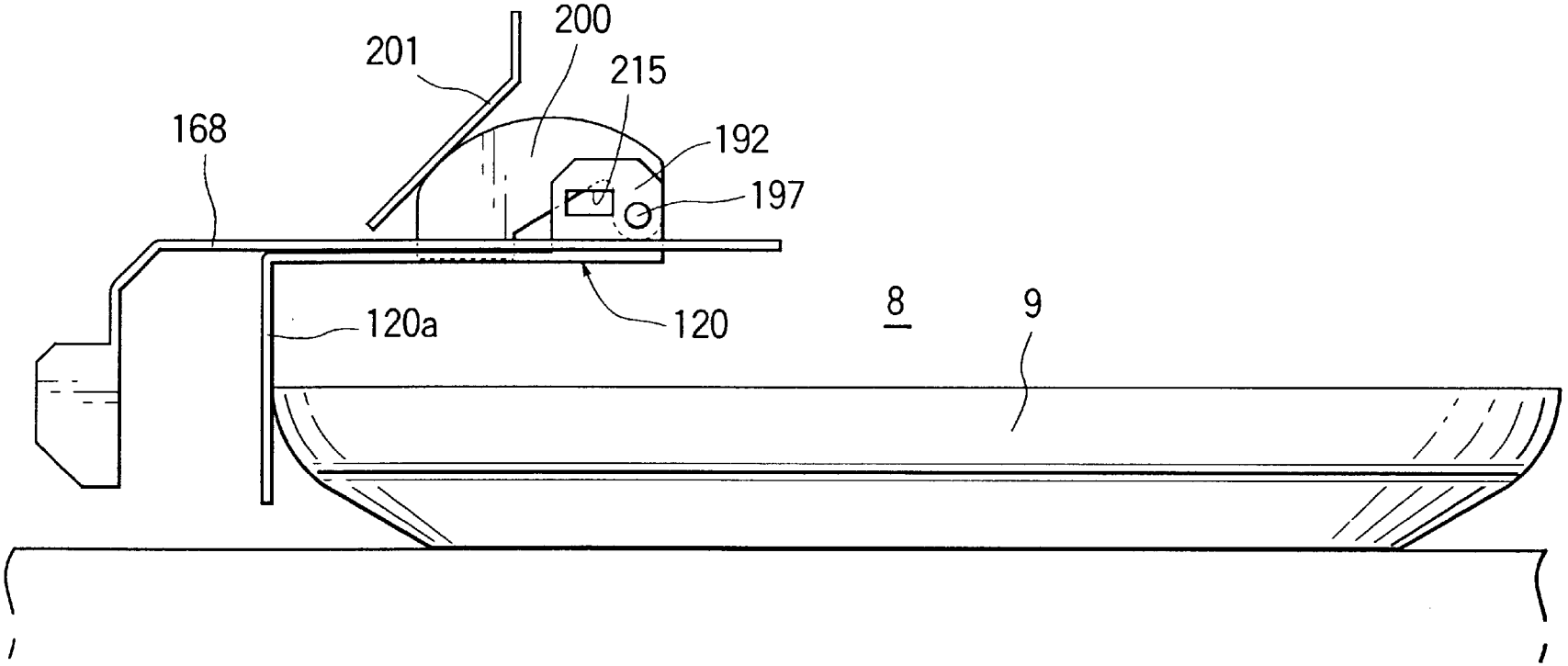
FIG. 23 is a schematic left side view showing a mechanism in the vicinity of a coin releasing opening of a chute when a receiving tray is about to be set in a coin dispensing opening.

FIG. 23 is a schematic left side view showing a mechanism in the vicinity of the coin releasing opening 119 of the chute 118, showing the receiving tray 9 in the process of being set in the coin dispensing opening 8.

As shown in FIG. 23, a shaft 197 extending in the widthwise direction is provided in the mounting member 192. As shown in FIG. 22, the shutter 120 is formed with a pair of slots 198 and a restricting member 200 biased upwardly by a spring 199 is swingably supported by the shaft 197. In FIG. 23, the reference numeral 201 designates a press member for abutting against the restricting member 200 and swinging it about the shaft 197 as the receiving tray 9 is inserted into the coin dispensing opening 8.

As shown in FIG. 22, a locking piece 211 is provided on the upper surface of the dispensing opening cover 168 so as to be swingable about a support shaft 210. The right end portion of the slide member 171 biased to the right in FIG. 22 by the spring (not shown) is connected to the rear end portion of the locking piece 211. In FIG. 23, the reference numeral 215 designates a cut portion formed in the mounting member 192 and engageable with the locking piece 211.

Figure 24:
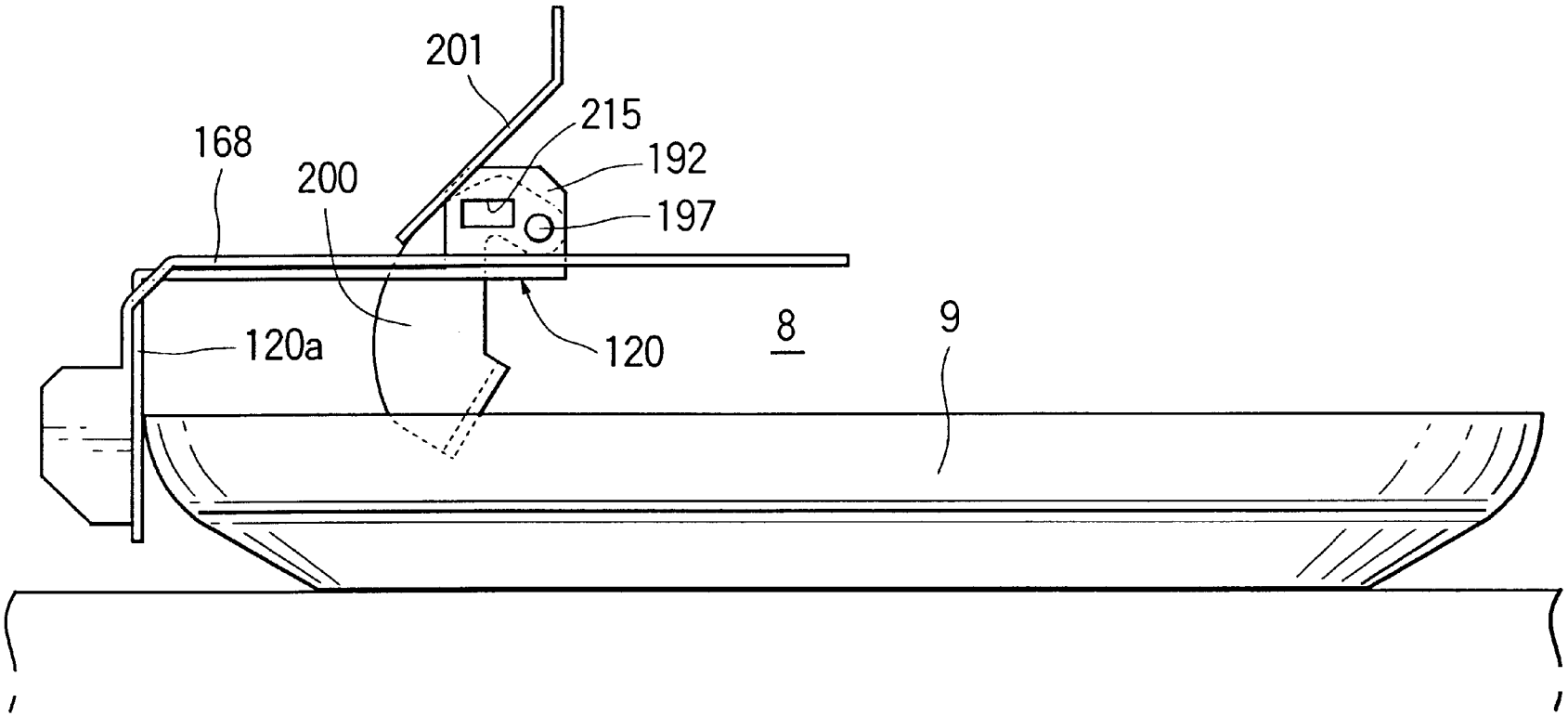
FIG. 24 is a schematic left side view showing a mechanism in the vicinity of a coin releasing opening of a chute when a receiving tray has reached a predetermined position.
Figure 25:
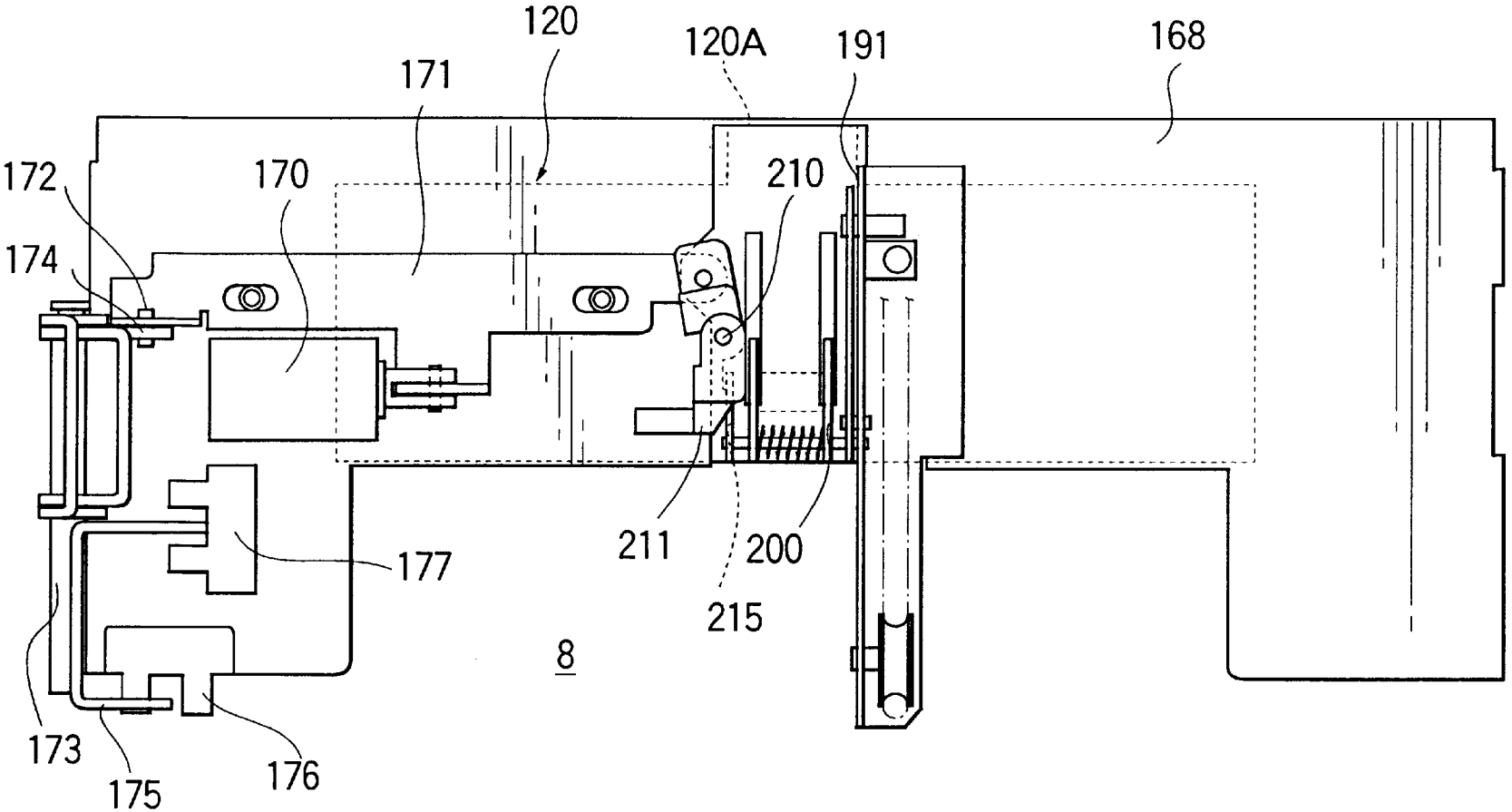
FIG. 25 is a schematic plan view showing a shutter locking mechanism and a receiving tray movement restricting mechanism when a receiving tray has reached a predetermined position.

FIG. 24 is a schematic left side view showing a mechanism in the vicinity of the coin releasing opening 119 of the chute 118 when the receiving tray 9 has reached a predetermined position and FIG. 25 is a schematic plan view showing the shutter locking mechanism and the receiving tray movement restricting mechanism when the receiving tray 9 has reached the predetermined position.

When an instruction signal requesting dispensation of coins is input through the operating section 5 after the receiving tray 9 has been inserted and reached the predetermined position, the thus constituted shutter locking mechanism and receiving tray movement restricting mechanism locks the shutter 120 to keep the coin releasing opening open and holds the receiving tray 9 at a predetermined position in the following manner.

The solenoid 170 is first driven and the slide member 171 is moved against the force of the spring (not shown) to the left in FIG. 22. As a result, the locking member 211 is swung about the support shaft 210 counterclockwise in FIG. 25 and engages with the cut portion 215 of the mounting member 192 pushed rearwardly by the receiving tray 9, thereby locking the shutter 120 to keep the coin releasing opening 119 of the chute 118 open.

On the other hand, as the receiving tray 9 is inserted into the coin dispensing opening 8, the restricting member 200 is pressed by the press member 201 to be swung about the shaft 197 counterclockwise in FIGS. 23 and 24. When the receiving tray 9 has reached the position shown in FIG. 24 and the shutter 120 is locked, one end portion of the restricting member 200 is positioned below the upper edge portion of the receiving tray 9. Therefore, the receiving tray 9 is prevented from being drawn out from the coin dispensing opening 8.

Thus, when all coins to be dispensed have been dispensed onto the receiving tray 9, the solenoid 170 is deenergized and the slide member 171 is moved by the force of the spring (not shown) to the right in FIGS. 22 and 25, thereby releasing the engagement between the locking member 211 and the cut portion 215 of the mounting member 192. As a result, when the receiving tray 9 is drawn from the coin dispensing opening 8, the shutter 120 is moved by the spring 196 so as to close the coin releasing opening 119, whereby the restricting member 200 is swung about the shaft 197 clockwise in FIGS. 23 and 24. Therefore, the receiving tray 9 can be drawn from the coin dispensing opening 8 without being restricted by the restricting member 200.

According to the above described embodiment, coins stored in the dispensable coin storing units 10*a*, 10*b*, 10*c*, 10*d*, 10*e*, 10*f* can be collected into the safe 110 via the collection chute 122 by drawing the safe accommodating box 160 from the coin receiving and dispensing machine 1 and positioning it in front of the coin receiving and dispensing machine 1 and coins stored in the coin temporary storing units 81*a*, 81*b*, 81*c*, 81*d*, 81*e*, 81*f* can be fed into the dispensable coin storing units 10*a*, 10*b*, 10*c*, 10*d*, 10*e*, 10*f* by merely dropping them. Therefore, all coins can be collected into the safe 110 when business has been completed without providing any special transport mechanism. Further, according to the above described embodiment, when the number of coins which any of the dispensable coin storing units 10*a*, 10*b*, 10*c*, 10*d*, 10*e*, 10*f* can store becomes less than a predetermined number, the second coin sorting section 61 feeds coins of the denomination to be stored in the dispensable coin storing unit 10*a*, 10*b*, 10*c*, 10*d*, 10*e* or 10*f* to the collected coin temporary storing unit 81 of the coin temporary storing section 81 to be collected by the safe 110. Therefore, even in the case where the coin storing capacity of the dispensable coin storing units 10*a*, 10*b*, 10*c*, 10*d*, 10*e*, 10*f* is small, the coin storing capacity thereof can be efficiently utilized to use received coins for dispensation.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, although the chute 118 and the collection chute 122 are separately provided, if a gate member is provided in the chute 118 or the collection chute 122 to selectively feed coins to the coin releasing opening 119 or coin feed-out opening 122*b*, it is not absolutely necessary to provide both the chute 118 and the collection chute 122 and a single chute suffices.

Further, in the above described embodiment, the first coin sorting section 51 for returning unacceptable coins to the coin returning opening 6 and the second coin sorting section 61 for selectively feeding acceptable coins to the collected coin temporary storing unit 81 of the coin temporary storing section 80 are provided. However, if a mechanism is provided in the first coin sorting section 51 or the second coin sorting section 61 for selectively feeding unacceptable coins to the coin returning opening 6 and acceptable coins to the collected coin temporary storing unit 81 of the coin temporary storing section 80, it is possible to omit one of the first coin sorting section 51 and the second coin sorting section 61.

Furthermore, in the above described embodiment, although only a single reverse rotating roller 113 is provided, one reverse rotating roller may be provided for each of the dispensable coin storing units 10*a,* 10*b,* 10*c,* 10*d,* 10*e* and 10*f.* Further, one reverse rotating roller may be provided for each group consisting of a plurality of the dispensable coin storing units 10*a,* 10*b,* 10*c,* 10*d,* 10*e,* 10*f.*

Moreover, in the above described embodiment, although only a single support plate 114 is provided, one support plate may be provided for each of the dispensable coin storing units 10*a,* 10*b,* 10*c,* 10*d,* 10*e* and 10*f.* Further, one support plate may be provided for each group consisting of a plurality of the dispensable coin storing units 10*a,* 10*b,* 10*c,* 10*d,* 10*e,* 10*f.*

According to the present invention, it is possible to provide a table-type coin receiving and dispensing machine which is compact and enables coins to be easily collected after the completion of business.

We claim:

1. A coin receiving and dispensing machine comprising a coin depositing opening through which coins can be deposited, a coin passage for transporting coins deposited through the coin depositing opening one by one, coin discriminating and counting means for discriminating whether or not coins are acceptable and the denominations of the acceptable coins and counting the coins, coin sorting means for sorting coins based on the result of the discrimination made by the coin discriminating and counting means, a coin temporary storing section for temporarily storing coins discriminated to be acceptable by the coin discriminating and counting means and sorted by the coin sorting means in accordance with their denominations, a dispensable coin storing section for receiving coins temporarily stored in the coin temporary storing section and storing them in accordance with their denominations, a safe for collecting coins, and chute means for feeding coins from the dispensable coin storing section to the safe, wherein the coin temporary storing section comprises a plurality of coin temporary storing units for temporarily storing coins for dispensation in accordance with their denominations and the dispensable coin storing section comprises a plurality of dispensable coin storing units for receiving coins from the plurality of coin temporary storing units and storing them in accordance with their denominations, each of the plurality of coin temporary storing units comprising a belt conveyor for receiving and transporting coins, each of the belt conveyors being swingable about a widthwise axis and the plurality of dispensable coin storing units being adapted to receive coins dropped from lower end portions of the swung belt conveyors.

2. A coin receiving and dispensing machine in accordance with claim 1 wherein the dispensable coin storing section is disposed below the coin temporary storing section and at a position where it can receive coins dropped from the coin temporary storing section.

3. A coin receiving and dispensing machine in accordance with claim 1 which further includes a coin dispensing opening through which coins can be dispensed and the chute means is adapted to selectively feed coins stored in the dispensable coin storing section to the safe or the coin dispensing opening.

4. A coin receiving and dispensing machine in accordance with claim 2 which further includes a coin dispensing opening through which coins can be dispensed and the chute means is adapted to selectively feed coins stored in the dispensable coin storing section to the safe or the coin dispensing opening.

5. A coin receiving and dispensing machine in accordance with claim 3 wherein the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

6. A coin receiving and dispensing machine in accordance with claim 1 wherein the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

7. A coin receiving and dispensing machine in accordance with claim 5 which further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

8. A coin receiving and dispensing machine in accordance with claim 6 which further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

9. A coin receiving and dispensing machine in accordance with claim 2 wherein the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

10. A coin receiving and dispensing machine in accordance with claim 4 wherein the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

11. A coin receiving and dispensing machine in accordance with claim 9 which further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

12. A coin receiving and dispensing machine in accordance with claim 10 which further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

13. A coin receiving and dispensing machine comprising a coin depositing opening through which coins can be deposited, a coin passage for transporting coins deposited through the coin depositing opening one by one, coin discriminating and counting means for discriminating whether or not coins are acceptable and the denominations of the acceptable coins and counting the coins, coin sorting means for sorting coins based on the result of the discrimination made by the coin discriminating and counting means, a coin temporary storing section for temporarily storing coins discriminated to be acceptable by the coin discriminating and counting means and sorted by the coin sorting means in accordance with their denominations, a dispensable coin storing section for receiving coins temporarily stored in the coin temporary storing section and storing them in accordance with their denominations, a safe for collecting coins, and chute means for feeding coins from the dispensable coin storing section to the safe, wherein the coin temporary storing section further comprises a collected coin temporary storing unit for temporarily storing coins sorted by the coin sorting means and to be collected into the safe and the coin receiving and dispensing machine further comprises a chute for feeding coins from the collected coin temporary storing unit to the safe.

14. A coin receiving and dispensing machine in accordance with claim 13 which further comprises a safe accommodating box which can accommodate the safe and be moved between a first position and a second position, the chute being constituted so as to communicate the collected coin temporary storing unit with the safe when the safe accommodating box is located at the first position, the chute means including a first chute for communicating the dispensable coin storing section with the safe when the safe accommodating box is located at the second position and a second chute for communicating the dispensable coin storing section with the coin depositing opening when the safe accommodating box is located at the second position.

* * * * *